US012312936B2

(12) United States Patent
Abdelaal

(10) Patent No.: US 12,312,936 B2
(45) Date of Patent: May 27, 2025

(54) METHOD FOR IMPROVED DRILLING PERFORMANCE AND PRESERVING BIT CONDITIONS UTILIZING REAL-TIME DRILLING PARAMETERS OPTIMIZATION

(71) Applicant: Halliburton Energy Services, Inc., Houston, TX (US)

(72) Inventor: Khaled Mohamed Hamed Abdelaal, Al Khuwair (OM)

(73) Assignee: Halliburton Energy Services, Inc., Houston, TX (US)

( * ) Notice: Subject to any disclaimer, the term of this patent is extended or adjusted under 35 U.S.C. 154(b) by 693 days.

(21) Appl. No.: 17/568,104

(22) Filed: Jan. 4, 2022

(65) Prior Publication Data

US 2023/0125398 A1 Apr. 27, 2023

Related U.S. Application Data

(60) Provisional application No. 63/272,532, filed on Oct. 27, 2021.

(51) Int. Cl.
*E21B 44/02* (2006.01)
*E21B 45/00* (2006.01)

(52) U.S. Cl.
CPC ..... *E21B 44/02* (2013.01); *E21B 45/00* (2013.01)

(58) Field of Classification Search
CPC ..... E21B 44/02; E21B 44/005; E21B 44/00; E21B 44/04; E21B 44/06; E21B 45/00; E21B 2200/20
See application file for complete search history.

(56) References Cited

U.S. PATENT DOCUMENTS

| | | | |
|---|---|---|---|
| 6,021,377 | A | 2/2000 | Dubinsky et al. |
| 6,155,357 | A | 12/2000 | King et al. |
| 6,424,919 | B1 | 7/2002 | Moran et al. |
| 7,142,986 | B2 | 11/2006 | Moran |
| 9,057,245 | B2 | 6/2015 | Wassell |
| 9,249,654 | B2 | 2/2016 | Strachan et al. |

(Continued)

OTHER PUBLICATIONS

Kristjansson, Sean D., et al., "Use of Historic Data to Improve Drilling Efficiency: A Pattern Recognition Method and Trial Results," IADC/SPE Drilling Conference and Exhibition, Mar. 1-3, 2016, 17 pages, Society of Petroleum Engineers.

(Continued)

*Primary Examiner* — Manuel L Barbee
(74) *Attorney, Agent, or Firm* — Conley Rose, P.C.; Rodney B. Carroll

(57) ABSTRACT

A method of optimizing a design of a wellbore drilling operation based on at least one set of offset well data. A drilling path record for each offset well comprises a set of drilling parameters separated into depth segments. An optimization process determines a drilling dysfunction for each set of drilling parameter by comparing the drilling parameter to a maximum value. The optimization process determines the maximum rate of penetration for each depth segment by comparing the sets of drilling parameters without a drilling dysfunction. The optimization process generates an optimum drilling roadmap in response to determining the drilling parameters for the maxim um rate of penetration for each depth segment. A drilling operation can drill a wellbore via the optimum drilling roadmap.

19 Claims, 14 Drawing Sheets

(56) References Cited

U.S. PATENT DOCUMENTS

| | | | | |
|---|---|---|---|---|
| 9,388,680 | B2 | 7/2016 | Moran | |
| 10,233,728 | B2 | 3/2019 | Kristjansson et al. | |
| 10,400,573 | B2 | 9/2019 | Yang et al. | |
| 10,577,914 | B2 | 3/2020 | Astrid et al. | |
| 2004/0124012 | A1 | 7/2004 | Dunlop et al. | |
| 2017/0328181 | A1 | 11/2017 | Kristjansson et al. | |
| 2020/0040719 | A1* | 2/2020 | Maniar | E21B 41/00 |
| 2022/0178240 | A1* | 6/2022 | Aman | E21B 45/00 |
| 2022/0397027 | A1* | 12/2022 | Guillot | E21B 45/00 |

OTHER PUBLICATIONS

"DrillPlan New Features," Schlumberger | Software, 14 pages, Schlumberger Limited.

Filing Receipt, Specification and Drawings for U.S. Appl. No. 63/272,532, entitled "Method For Improved Drilling Performance And Preserving Bit Conditions Utilizing Real-Time Drilling Parameters Optimization," filed Oct. 27, 2021, 40 pages.

Abdelaal, K. et al., "Holistic Real-Time Drilling Parameters Optimization Delivers Best-in-class Drilling Performance And Preserves Bit Condition—A Case History From A LSTK Project in Oman," SPE Canadian Energy Technology Conference, Mar. 16-17, 2022, 2 pages, Society of Petroleum Engineers International.

"Record Breaking Optimization Results in Oman," Jul. 13, 2021, pp. 1-8, Halliburton.

* cited by examiner

610

502 504 506 508 614

| | Well | Depth | ROP | WOB | RPM | ROP Limiter (Control State) |
|---|---|---|---|---|---|---|
| 602 | Well 156 | 1 | 4 | 25 | 48 | Diff. Press |
| | Well 158 | 1 | 9 | 21 | 50 | WOB |
| | Well 160 | 1 | 7 | 27 | 49 | ROP |
| | Well 164 | 1 | 8 | 18 | 62 | Torque |
| 604 | Well 156 | 2 | 13 | 25 | 48 | System is off |
| | Well 158 | 2 | 11 | 20 | 50 | WOB |
| | Well 160 | 2 | 15 | 27 | 49 | Diff. Press |
| | Well 164 | 2 | 9 | 18 | 45 | LWD Telemetry |
| 606 | Well 156 | 3 | 19 | 25 | 48 | LWD Telemetry |
| | Well 158 | 3 | 12 | 18 | 50 | WOB |
| | Well 160 | 3 | 14 | 27 | 49 | Torque |
| | Well 164 | 3 | 16 | 18 | 45 | Diff. Press |

FIG. 6B

610

| Well | Depth | ROP | WOB | RPM | ROP Limiter (Control State) |
|---|---|---|---|---|---|
| Well 160 | 1 | 7 | 18 | 45 | Torque |
| Well 158 | 2 | 11 | 20 | 50 | WOB |
| Well 164 | 3 | 16 | 18 | 45 | Diff. Press |

FIG. 6C

METHOD FOR IMPROVED DRILLING PERFORMANCE AND PRESERVING BIT CONDITIONS UTILIZING REAL-TIME DRILLING PARAMETERS OPTIMIZATION

CROSS-REFERENCE TO RELATED APPLICATIONS

This application claims priority under 35 U.S.C. § 119(e) to U.S. Provisional Patent Application No. 63/272,532 filed on Oct. 27, 2021 and entitled "Method for Improved Drilling Performance and Preserving Bit Conditions Utilizing Real-Time Drilling Parameters Optimization," the disclosure of which is hereby incorporated herein by reference in its entirety.

BACKGROUND

In oil and gas wells a primary purpose of drilling a wellbore is the extraction of hydrocarbons from a hydrocarbon bearing formation. These oil and gas wells may be drilled through a variety of subterranean formations.

Typically an oil well is drilled to a desired depth with a drill bit and mud fluid system. Wellbore drilling includes rotating a drill bit while controlling the application of axial force to the drill bit. The rotation and applied axial force are typically controlled by equipment at the surface generally referred to as a drilling rig. The drilling rig includes various equipment to lift, rotate, and control segments of drill pipe coupled to the drill bit. The mud fluid system is pumped down the drill pipe to cool the drill bit and transport drill cutting to surface.

The speed the drill bit penetrates the subterranean formation depends on the mechanical properties of the subterranean formation, the size and type of the drill bit, the rotary speed and the axial force applied to the drill bit. The rate of penetration of the drill bit depends on the rotary speed and axial force applied to a drill bit for a given subterranean formation. Concurrently, the rate at which a drill bit dulls or wears out is also controlled by the rotary speed and axial force applied to the same drill bit. A method for improving the drilling performance while preserving drilling bit conditions is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIGS. 6B and 6C are illustrations of a table of drilling parameters according to an embodiment of the disclosure.

DETAILED DESCRIPTION

Figure 1:
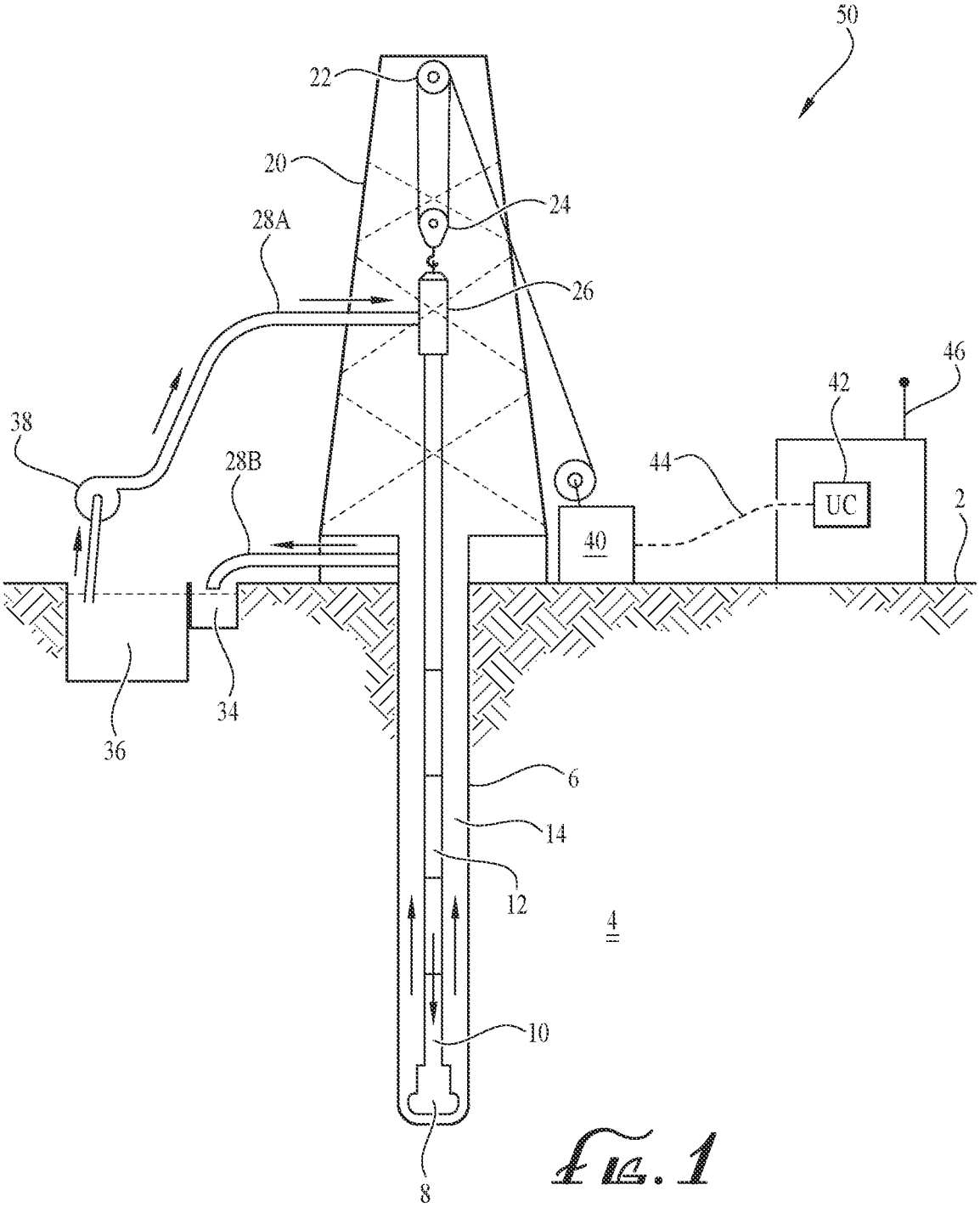
FIG. 1 is a cut-away illustration of an embodiment of a well system.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Drilling multiple wells within a known oil field can maximize the operational use of equipment and personnel. The drilling of multiple wells within the same area using similar equipment, mud systems, and well configurations can be referred to as batch drilling. The use and reuse of equipment can lower the capital cost for the driller and thus the service cost for the customer.

Batch drilling can lower the cost of drilling by improving drilling efficiency by applying lesson learned from a pilot well to the neighboring wells. The use of similar drilling assemblies, e.g., drilling bits, and mud systems within the same subterranean formation can reduce the number of downhole problems, e.g., struck pipe, by pre-planning to avoid similar problems.

Tripping the drill pipe out of the well to replace a dulling or damaged drill bit significantly increases the cost of drilling. The speed of drilling a wellbore is generally referred to as the rate of penetration (ROP). Maximizing the ROP for a drill bit can shorten the drilling time, but also prematurely dull a drill bit. A drilling operation with a lower ROP can enable the drill bit to drill the wellbore for a longer time and subsequently a farther distance. Drilling longer with the same drill bit lowers the cost and increases the efficiency of the drilling operation. Controlling the factors that cause the dulling of a drill bit, such as excessive weight on bit, is desirable. A holistic approach to maximizing the ROP while controlling the factors that dull or damage the bit is desirable.

In some embodiments, an optimization process for designing a wellbore drilling roadmap for a drilling operation to utilize can increase the efficiency of drilling a well. The optimization process can identify offset wells to model an optimum drilling roadmap. The optimization process can develop an drilling path record for each offset well comprising drilling parameters separated by depth segments. The optimization process can compare the drilling path records to determine the maximum rate of penetration for each depth segment. The optimization process can exclude the offset well segments containing drilling dysfunctions and select the drilling parameters that resulted in the maximum rate of penetration. The optimization process can develop an optimum drilling parameters roadmap consisting of the drilling parameters for the maximum rate of penetration for each drilling segment from surface to the bottom of the well. The optimum drilling parameters roadmap can be transmitted to a unit controller on a remote drilling rig. The driller can monitor the drilling operations via a display as a drilling process, e.g., Auto-driller, follows the optimum drilling parameters roadmap.

Turning now to FIG. 1, illustrated is a wellbore drilling environment 50 that can be utilized to drill and monitor the drilling of a wellbore. In some embodiments, the wellbore 6 can be drilled into the subterranean formation 4 using any suitable drilling technique and can extend in a substantially vertical direction away from the earth's surface 2. At some point in the wellbore 6, the vertical wellbore portion can transition into a substantially horizontal wellbore portion. The drilling system can include a drill bit 8 and a bottom hole assembly 10 mechanically coupled to a tubular commonly referred to as drill pipe 12. The drill pipe 12 generally comprises an inner bore for the transfer of drilling fluids to the drill bit 8. The drilling fluids, e.g., drilling mud, can cool and lubricate the drill bit 8 and lift drill cuttings to the surface along the annulus 14 between the drill pipe 12 and wellbore 6. In some contexts, the drill pipe 12 can be referred to as a drill string 12.

The drilling system can comprise a drilling rig 20 including a lifting mechanism, a fluid system, and a rotation mechanism. The lifting mechanism can be described as a block and tackle system including a crown block 22 and a traveling block 24 releasably connected to the drill string 12. The crown block 22 stays stationary while the traveling block 24 raises and lowers the drill string 12 and downhole assembly, e.g., drill bit. A draw-works 40 can provide the mechanical force, via a drill line, to raise and lower the traveling block 24. The lifting mechanism can control the amount of weight applied to the bottom hole assembly (BHA) 10 and drill bit 8. The lifting mechanism may include a plurality of sensors such as block height sensor, block speed sensor, hook load sensor, and weight indicator.

The drilling system can comprise a fluid system to transport drill cuttings to surface. The fluid system can provide the drilling fluid flowrate and pressure down the inner bore of the drill string 12 to the drill bit 8. The fluid system can comprise a return line 288, a shale shaker 34, a mud tank 36, a suction line, a mud pump 38, a stand pipe 28A, and a swivel 26. The fluid system provides a fluid circuit to transport drill cuttings to surface, separate the cuttings, and circulate clean drilling mud back to the drill bit 8. The mud tank 36 provides the mud pump 38 a volume of drilling fluid to circulate down the drill string 12 via the stand pipe 28A and swivel 26. The drilling fluid, e.g., drilling mud, cools and lubricates the drill bit 8 while transporting the drill cuttings back to surface via the annulus 14. The shale shaker 34 receives the drilling fluid, via the return line 28B, separates the drill cuttings from the drilling mud, and returns the drilling mud to the mud tank 36 to cool. The fluid system may include a wellhead, blowout preventer, and bell nipple for pressure control of the wellbore environment. The fluid system may include a plurality of sensors such as flowrate sensors, pressure sensors, and tank volume sensors.

The drilling rig 20 can comprise a rotation mechanism for rotating the drill string 12. The rotation mechanism can provide the rotational speed of the drill bit 8 and drill string 12. The rotational mechanism for the drilling rig 20 can include a kelly, a kelly bushing, and a rotary table. The rotary table can mechanically couple the kelly with the kelly bushing to the rig structure to provide rotation to the drill string 12. The rotation of the rotary table provides rotation to the drill string 12 via the kelly. In a context, the rotational motion mechanism of the drilling rig 20 can include a top drive device to provide mechanical rotation of the drill string 12. The rotation mechanism can include sensors such as torque sensor and rotary speed sensor.

The wellbore drilling environment 50 may include surface equipment for the control and monitoring of the drilling process. The drilling system can include a unit controller 42 comprising a processor, a non-transitory memory, and a communication device 46. The unit controller 42 can be communicatively connected to the drilling system via wired cable 44 or a wireless communication method, e.g., WIFI. The unit controller 42 can direct the drilling via drilling personnel, e.g., the driller, or may automate a portion of the drilling process via wired or wireless communication. A plurality of sensors for the lifting mechanism, the fluid system, the rotation mechanism, and the wellhead can provide feedback to the unit controller 42 via a data acquisition (DAQ) unit. The communication device 46 can communicatively connect the unit controller 42 to one or more remote user devices as will be disclosed herein after.

The data gathered by the sensors can include stress, strain, flow rate, pressure, temperature, and acoustic data. The fluid sensors can include a communication method for the BHA 10.

Although the wellbore drilling environment 50 is illustrated as a wellsite on land, it is understood that the wellbore drilling environment 50 can be offshore. The wellhead can be mechanically coupled to surface casing to anchor the wellhead and blowout preventer at surface 2. The wellhead can include any type of pressure containment equipment connected to the top of a casing string, such as a surface tree, production tree, subsea tree, lubricator connector, blowout preventer, or combination thereof. The wellhead can be located on a production platform, a subsea location, a floating platform, or other structure that supports operations in the wellbore 6. In some cases, such as in an off-shore location, the wellhead may be located on the sea floor while the drilling rig 20 can be located on a structure supported by piers extending downwards to a seabed or supported by columns sitting on hulls and/or pontoons that are ballasted below the water surface, which can be referred to as a semi-submersible platform or floating rig.

Figure 2:
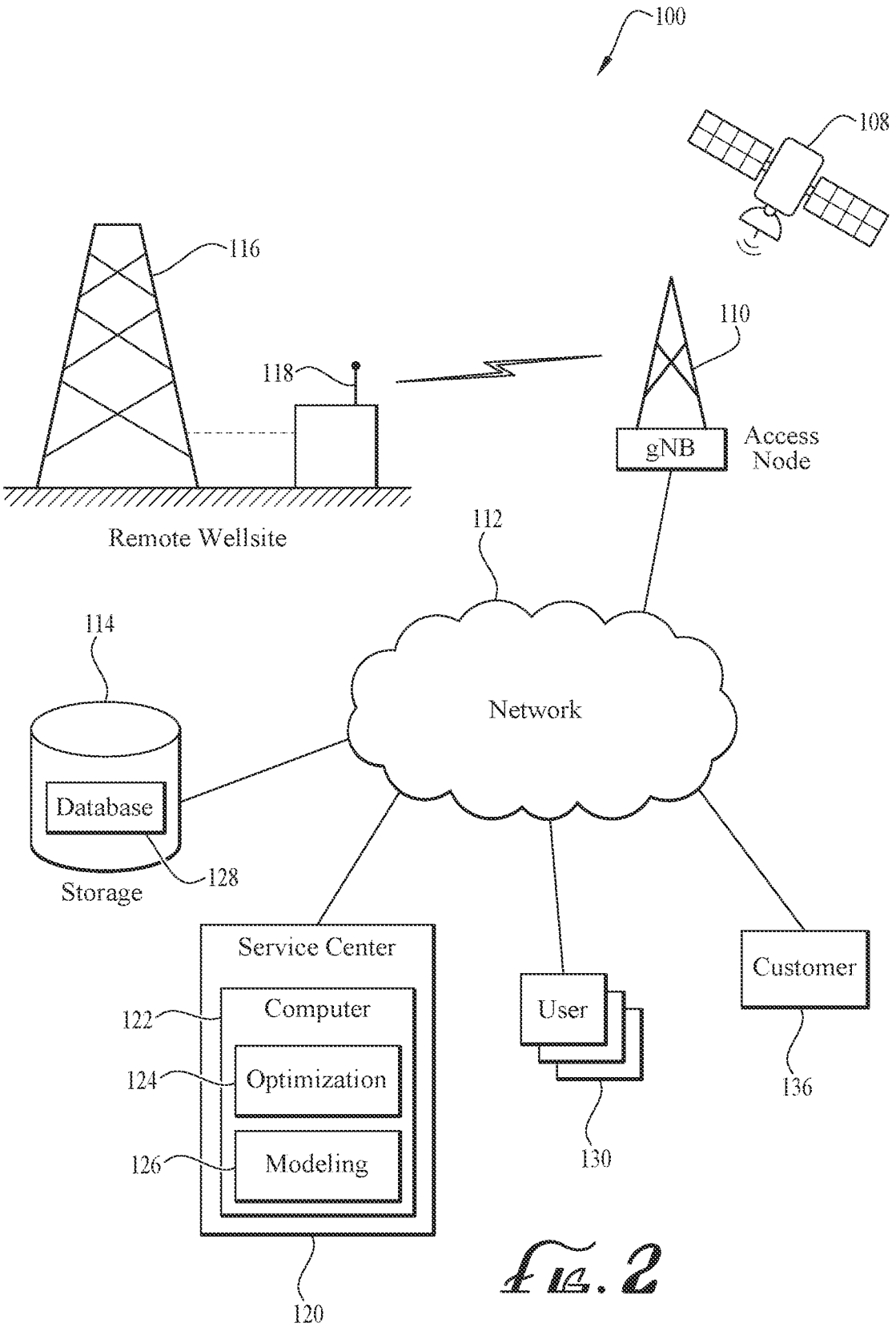
FIG. 2 is a block diagram of a communication system according to an embodiment of the disclosure.

Turning now to FIG. 2, a communication system 100 is described. The communication system 100 comprises a remote wellsite 116, a cellular site 110, a network 112, a storage computer 114, a computer system 122, a plurality of user devices 130, and a customer device 136. A remote wellsite 116 with a communication device 118 (e.g., communication device 46 of FIG. 1) can transmit via any suitable communication means (wired or wireless), for example wirelessly connect to a cellular site 110 to transmit data to a storage computer 114. The cellular site 110 can be communicatively connected to a network 112 that can include a 5G network, one or more public networks, one or more private networks, or a combination thereof. A portion of the internet can be included in the network 112. The storage computer 114 can be communicatively connected to the network 112. The service center 120 can have one or ore servers and/or computer systems 122. An drilling optimization application 124 can be executing on a computer system 122 in the service center 120.

A communication device 118 on a remote wellsite 116 can transmit data collected from the equipment sensors, wellhead sensors, and/or BHA 10 to the storage computer 114. The communication device 118 can comprise a storage device and a data transmission device. The communication device 118 can wirelessly connect to the cellular site 110 continuously or at a predetermined schedule. In some embodiments, the communication device 118 can connect or attempt connection to the storage computer 114 via the cellular site 110 based on an established schedule. In some embodiments, the drilling optimization application 124 can request the data from the communication device 118 based on an established schedule. The storage computer 114 can connect or attempt connection to the communication device 118 via cellular site 110 based on an established schedule. The communication device 118 can wirelessly connect to the network 112 via satellite communication 108.

The storage computer 114 can include a historical database 128 of datasets from remote drilling operations. A remote wellsite 116 can transmit one or more datasets indicative of a drilling operation. For example, the historical database 128 may comprise a plurality of datasets from wellbore drilling operations at remote wellsites, e.g., 116. The plurality of datasets within the historical database 128 may comprise one or more remote wellsites within the same field as will be described further herein.

A user device 130 can transfer a dataset from the storage computer 114 to an drilling optimization application 124 executing on a computer system 122 in the service center 120. The dataset can include the data collected from remote wellsite 116 over a designated time period. The dataset can include a dataset from a complete drilling operation. Alternatively, a dataset from the storage computer 114 can be transferred automatically or via a scheduler to an drilling optimization application 124. The drilling optimization application 124 can determine a drilling procedure for a remote wellsite 116. The user device 130 can receive customer inputs from a customer device 136. The user device 130 can transmit the customer inputs and at least one dataset from the historical database 128 to the analysis process via the drilling optimization application 124. The drilling optimization application 124 can compare a generic drilling procedure to the dataset from the historical database 128 to generate a recommended drilling procedure.

A remote wellsite 116 may transmit a periodic dataset indicative of a current drilling operation to the drilling optimization application 124. The drilling optimization application 124 may recommend changes to the recommended drilling procedure based on one or more periodic datasets received from the remote wellsite 116 via the communication device 118.

Figure 3:
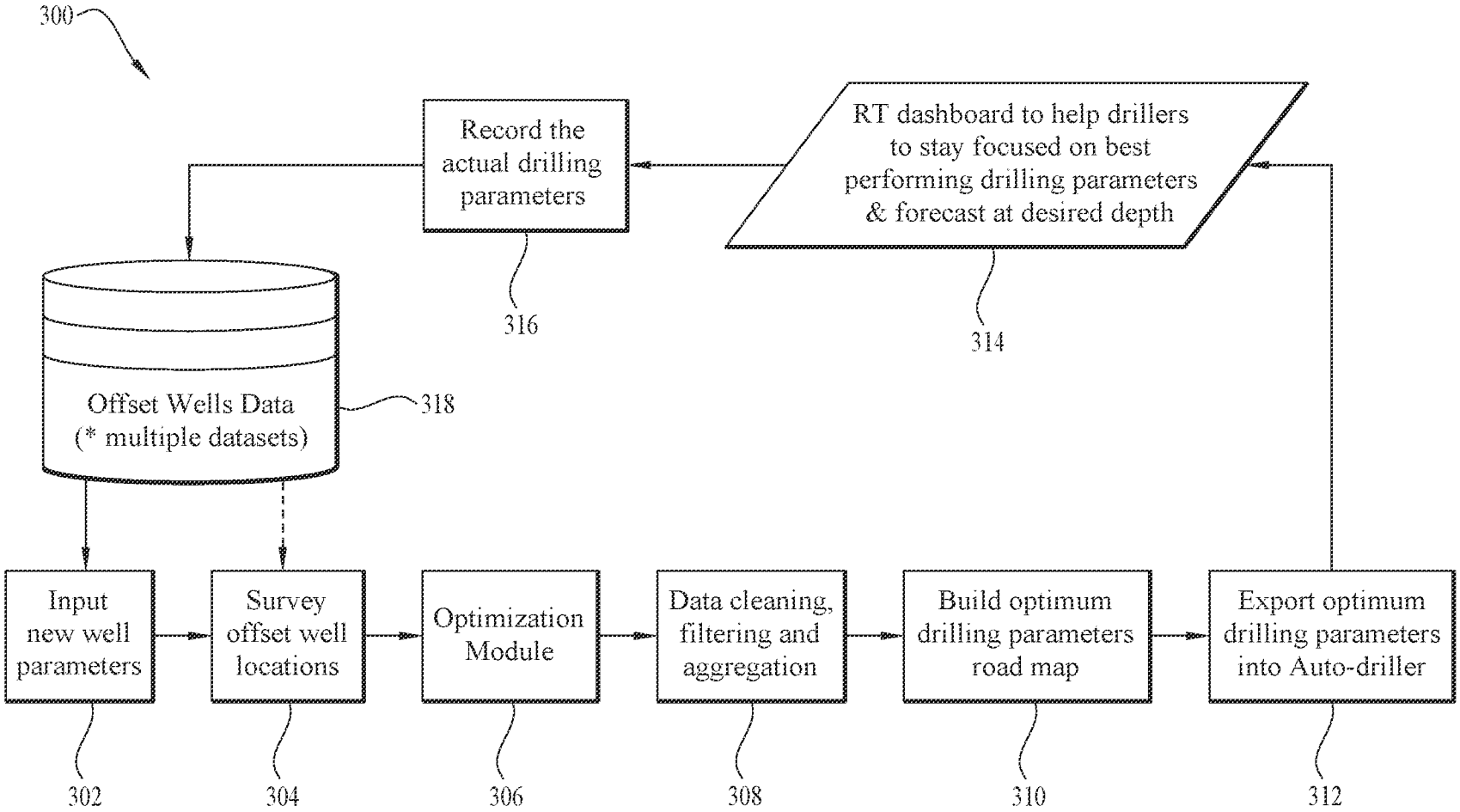
FIG. 3 is an illustration of the logical flow diagram depicting a drilling parameter optimization method according to an embodiment of the disclosure.

A design process can determine the maximum ROP for the drilling operation based on historical drilling data. The design process can generate a drilling plan to maximize the ROP within the drilling equipment limits based on the data generated from previous drilling operations. The design process can determine the drilling plan without considering the formation compressive strength. The drilling plan can include a BHA and a drilling sequence. The BHA can include a directional drilling motor, e.g., MWD or LWD, and a drill bit. The BHA can be powered and directed by the drilling equipment, e.g., drilling rig and mud system, at surface. The drilling sequence may be a series of steps defining one or more parameters of a drilling procedure as a function of time or as a function of distance. The distance can be measured along the longitudinal axis of the BHA and/or drill string, e.g., drill pipe. The distance can be measured from the surface and referred to as the measured depth. The measured depth may be divided into depth segments of equal or unequal lengths. The depth segments may correspond to subterranean feature such as a formation, wellbore feature, wellbore size, or a drilling equipment feature such as a drill bit size. The drilling sequence can include the trajectory, e.g., drilling path, and drilling parameters, e.g., WOB. The drilling sequence can specify the minimum and maximum drilling parameters for each depth segment to generate the maximum ROP. The method can determine the drilling parameters for each depth segment from the historical drilling data by comparing the ROP and corresponding drilling parameters of similar offset wells. Turning now to FIG. 3, a method 300 of determining a wellbore drilling procedure based on drilling data within a historical database is illustrated as a logic block diagram. In some embodiments, the method 300 comprises the following steps executing in a drilling optimization application. At step 302, the user can input a set of parameters for the new well into a drilling optimization application, e.g., application 124 of FIG. 2. The user may receive a request from a customer via the customer device 136 (shown in FIG. 2) that includes a geographic location of a new well to be drilled. The user can select a drilling bit 8 and BHA 10 based on the customer request and/or equipment availability. The user can input the request into the drilling optimization application 124 of FIG. 2 via the user device 130.

Figure 4A:
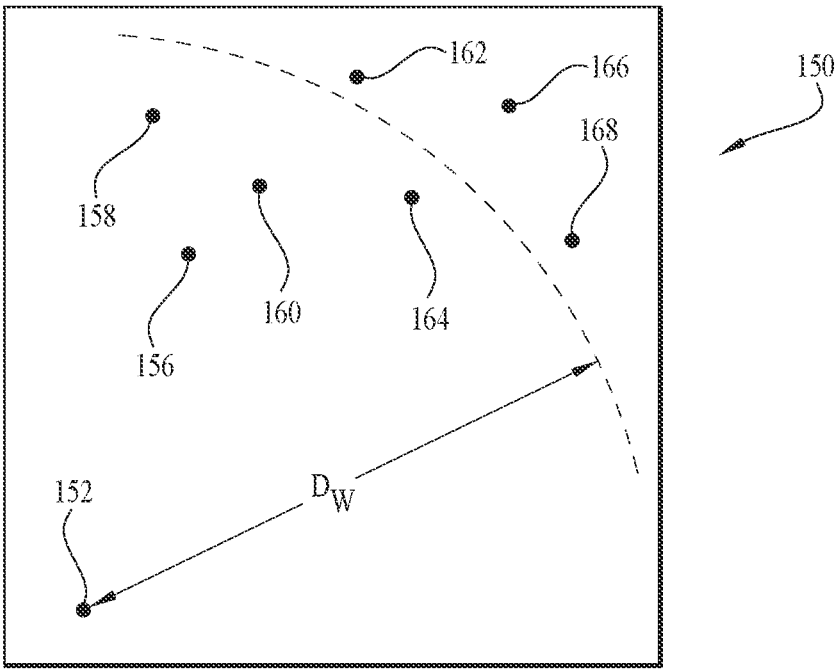
FIGS. 4A and 4B are illustrations of a wellsite surrey according to an embodiment of the disclosure.

The design process, e.g., a drilling optimization application, may identify at least one offset well from a historical database. At step 304, the drilling optimization application 124 can generate a wellsite survey from the geographic location of the new wellsite. Turning now to FIG. 4A, the drilling optimization application 124 can generate a wellsite survey 150 from the geographic location of the new wellsite 152 comprising existing wellsites proximate to the new wellsite. In some embodiments, the wellsite survey 150 may be an elevated view or aerial view, also referred to as a bird's-eye view, of the wellsites surrounding the new wellsite location. The aerial view may have generated from a perspective of 1,000 meters above the new wellsite 152. Although the aerial view is defined as 1 kilometer (km), it is understood that the aerial view perspective may be anywhere within the range of 0.5 km to 12 km. The wellsite survey 150 may display a plurality of existing wellsites, e.g., existing well 154, located some distance away from the new wellsite 152. The distance between the wellsites may depend on the distance or elevation of the aerial view above the surface of the earth. In an example, the wellsite survey 150 may comprise the new wellsite 152 and a number of offset wells 156-168. From the user device 130, the user can select at least one offset wellsite, e.g., offset well 156, as a comparison well to generate the optimum drilling roadmap. Each offset well selected by the user can be included in a set of selected offset wells e.g., offset well 156. In the example shown in FIG. 4A, the new wellsite 152 can be the eighth well drilled as part of the development of a large oil field. In this scenario, many of the characteristics of the drilling operation for the new wellsite 152 are known such as formation characteristics, geology, reservoir depth, and reservoir properties. Although the new wellsite 152 is not shown as centered in the wellsite survey 150, it is understood that the view or display of the wellsite survey 150 may be panned to move the new wellsite 152 to an edge location and thus display wellsites that are distant from the new wellsite, for example, offset well 166.

At step 306, the application 124 may recommend an optimization mode via the user device 130. In some embodiments, the application 124 may recommend building the optimum drilling roadmap in an automatic mode in response to the availability of offset wells 156-166. For example, in FIG. 4A, the application 124 may recommend a plurality of offset wellsites, e.g., offset well 156, based on the proximity of the offset wells 156-166 to the new wellsite 152. The user may accept or reject the offset wells 156-166 based on distance from the new wellsite 152, the hole size, the size of the drill bit, the type of the drill bit, the BHA utilized, the formations encountered, the wellbore path, or a combination thereof. The hole size may refer to the wellbore diameter and/or the outside diameter of the drill bit. For example, the size of the drill bit can refer to the outside diameter of the drill bit that produces the inside diameter of the wellbore, e.g., wellbore diameter, that can also be referred to as the hole size. In some scenarios, the motion of the drill bit within a subterranean formation can cause a bit motion that produces a slightly larger hole size, e.g., wellbore diameter. The user may select to add an offset well, for example offset well 156, to a set of selected offset wells selected in step 304 or may modify the set of selected offset wells by adding and/or removing offset wells, e.g., offset well 156, from the set. For example, the application 124 may recommend the offset wells 156-166 be added to the set of selected offset wells, however, the user may remove offset well 162, offset well 166, and offset well 168 from the set of selected offset wells based on the distance Dw from the new wellsite 152. The distance Dw may be measured in inches, feet, miles, meters, kilometers, or any combination thereof. The distance of Dw is representative of a measured distance in which the subterranean formations change from a first arrangement of formations to a second arrangement, e.g., one field to another, and not an actual measured value. The offset well 162, offset well 166, and offset well 168 may be located in a different field with different formation locations. In the automatic mode, the application 124 may determine an optimum drilling roadmap by comparing the drilling parameters of the set of offset wells as will be described herein.

Also at step 306, the application 124 may recommend a manual mode instead of the automatic mode. In some embodiments, the application 124 may recommend a manual mode if the offset well data is not available, for example if an offset well does not exist. In another scenario, the application 124 may recommend a manual mode if the offset well data is not applicable to the new wellsite 152, for example the hole size is different, the drilling equipment is different, the BHA is different, the drilling equipment does not exist in the historical database 128, or combinations thereof. In an example illustrated in FIG. 4B, the wellsite survey 150 may show only a single existing well 154 at a distance greater than the distance Dw. The existing well 154 may be too far away from the new wellsite 152 and located in a different field with different formation tops and/or reservoir locations. The datasets from the past drilling operation of the existing well 154 may not be indicative of the future drilling operation for the new wellsite 152. In this scenario, the new wellsite 152 can be referred to as an exploratory well, an appraisal well, or a discovery well. The application 124 may recommend a manual mode instead of the automatic mode for determining the optimum drilling roadmap. In another scenario, the existing well 154 may have utilized a different BHA, hole size, drill bit type, or combinations thereof. The application 124 may recommend a manual mode when the one or more offset wells utilize dissimilar equipment. In another scenario, the application 124 may recommend the manual mode if data for the drilling equipment, such as the BHA, drill bit, or combinations thereof, is not found in the historical database 128. In the manual mode, the user may input the maximum values for the drilling parameters into the application 124 as be described herein.

The user may repeat steps 302 304, and 306 during the selection process for the application 124. These steps may be performed in sequence or out of sequence including the selection of the mode, automatic mode or manual ode, and the user moves to the subsequent step.

At step 308 the application 124 can import a drilling dataset for data processing. In some embodiments, the application 124 can retrieve a drilling dataset for at least one offset well, e.g., offset well 156, selected in step 306 from the historical database 128. The drilling dataset for each offset well, e.g., offset well 156, comprises drilling equipment datasets. BHA datasets, mud system datasets, daily drilling reports, or combinations thereof. The datasets from the drilling equipment (e.g., 40 from FIG. 1) can include measurements from drilling equipment such as weight on bit (WOB), RPM, ROP, torque, daily drilling reports, or combinations thereof. The BHA datasets from the BHA 10 can include geologic data, wellbore temperature, wellbore pressure, fracture gradient, pore pressure, fluid loss data, lithology, formation porosity, formation permeability, wellbore trajectory, or combinations thereof. The mud system datasets can include pump pressure, circulation pressure, density, flow rate, mud rheology, fluid returns fluid loss, daily drilling reports, or combinations thereof. The geologic data can include the location of formation top, the type of formation, the length of each formation, formation properties, mineralogy, and porosity. The well trajectory comprises the well measured depth, true vertical depth, buildup rate, and deviation from the vertical. The daily drilling reports comprises a summary of 24 hours of drilling operations at a given wellsite including drilling bit 8 used (with size and serial numbers), depths (kelly bushing depth, ground elevation, drilling depth, drilling depth progress, water depth), daily drilling issues, tubulars (casing and tubing joints and footages) run and cement used, vendors and their services, well bore survey results, work summary, work performed and planned. The data gathered may be in the form of direct measurements, for example, the depth of a formation top. The data gathered may be time-based measurements, also referred to as periodic datasets, for example drilling parameters. Drilling parameters are defined as drilling equipment operational values that effect the drilling rate of penetration (ROP) including weight on bit (WOB), fluid flow rate, drilling fluid viscosity, drilling fluid density, the torque on the drilling bit 8, and the rotational speed of the drill bit 8 (RPM).

In some embodiments, the application 124 may process raw mud-pulse data. The BHA dataset from the BHA 10 can include raw data, e.g., mud-pulse data, processed data, or combinations thereof. The raw data comprises measurements by gamma ray, neutron density, resistivity, or combinations thereof in the form of mud-pulse signals. The data process can transform the mud-pulse data into processed datasets with measurement values, e.g., temperature values. The processed datasets from the BHA 10 can comprise the wellbore measurements and/or formation data values in the form of formation lithology, pore pressure, or combinations thereof. The processed datasets from the BHA 10 can comprise periodic datasets, for example wellbore trajectory.

In some embodiments, the application 124 may process periodic datasets, e.g., the time-based drilling parameters, after retrieval from the historical database 128. The application 124 may produce a post-processing periodic dataset from the sensor datasets comprising a periodic dataset, a measurement dataset, or combinations thereof by applying one or more data reduction techniques to smooth the periodic set of sensor data. The data reduction techniques may include data pre-processing, data cleansing, numerosity reduction, or a combination thereof. The data pre-processing technique may remove out-of-range values and flag missing values within the dataset. The data cleaning process may include the use of statistical methods, data duplicate elimination, and the parsing of data for the removal of corrupt or inaccurate sensor data points. The post-processing periodic sensor dataset may be saved to memory, the storage computer 114, the historical database 128, or combinations thereof.

In some embodiments, the post-processing periodic dataset may be averaged to produce an averaged value representative for each set of periodic data, measurement data, or combinations thereof. The average value may be a single value that represents a plurality of values across a given duration. The average value may be determined by applying one or more mathematical techniques such as an arithmetic mean, a median, a geometric median, a mode, a geometric mean, a harmonic mean, a generalized mean, a moving average, or combination thereof. The application 124 may save the average value from the sensor dataset to memory, the storage computer 114, the historical database 128, or combinations thereof. In some embodiments, the average value may be determined as each of the plurality of periodic datasets, measurement datasets, or combinations thereof is generated, for example, in real-time or, alternatively, at a later time.

Figure 5A:
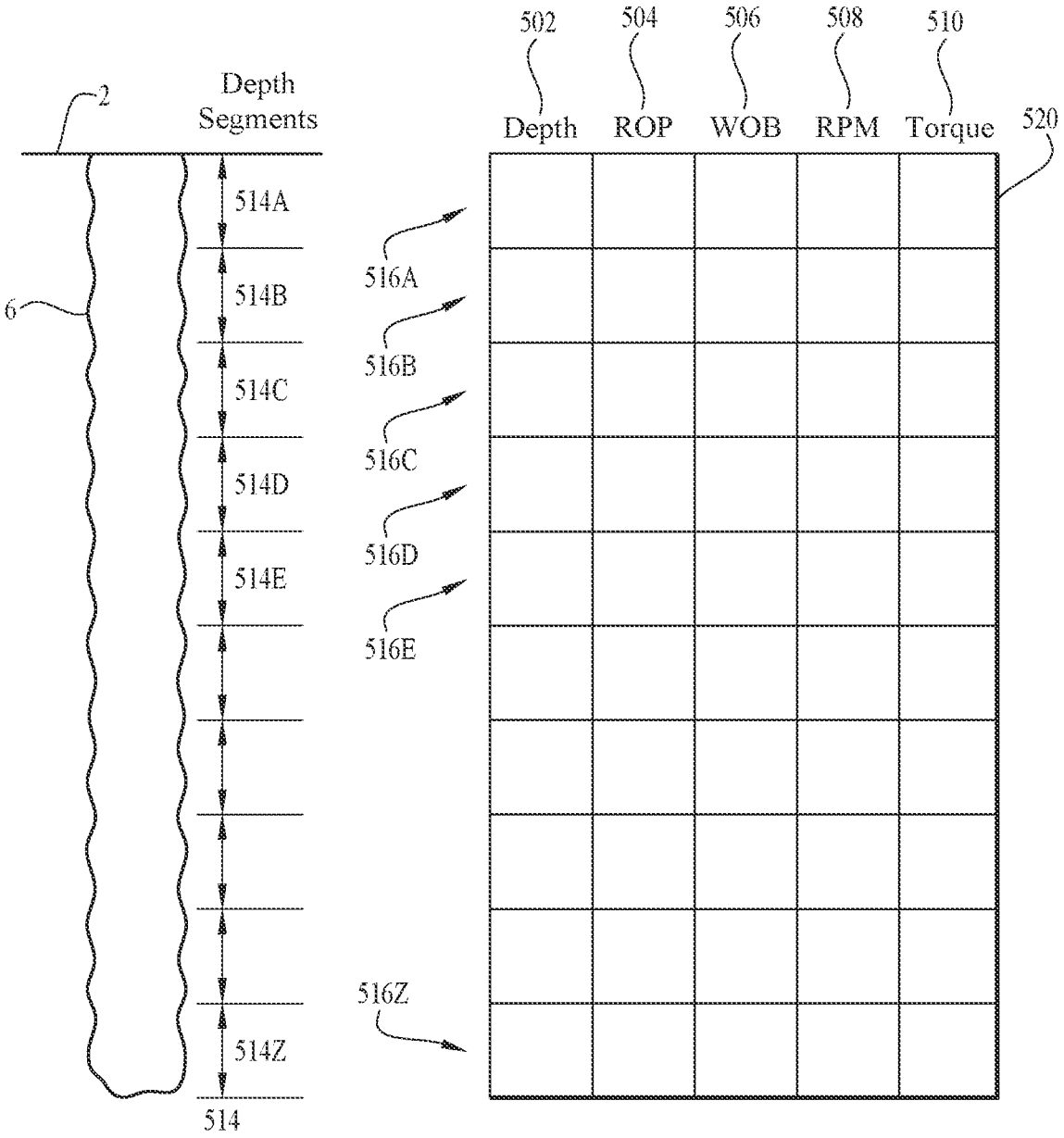
FIG. 5A is an illustration of the method of generating a drilling path record according to an embodiment of the disclosure.

At step 310, the application 124 may build an optimum drilling roadmap. In some embodiments, the application 124 can partition the design wellbore drilling path into depth segments 514 as illustrated in FIG. 5A. A depth segment 514 can include a linear distance measured along the axis of the wellbore 6. For example, a depth segment 514 can be one foot of the total length of the well. The depth segment 514 can be equal in size from the surface 2 to the bottom, e.g., the end, of the wellbore 6. A wellbore 6 that measures 10,000 ft can include 10,000 separate depth segments 514 of one foot length. The depth segments 514 can be sequentially placed. For example, depth segment 514A begins at the surface 2 and extends towards the bottom of the wellbore 6 for a predetermined length, e.g., one foot. Depth segment 514B begins at the end of depth segment 514A and extends towards the bottom of the wellbore 6. Each subsequent depth segment 514, for example 514A through 514Z, begin at the end of the previous depth segment 514. In an alternative embodiment, the depth segment 514 can vary in length. For example, the depth segments 514 near the surface 2, for example 514A, 514B, and 514C may be ten foot in length and the depth segments 514 at the bottom of the wellbore 6, for example depth segment 514Z in a formation of interest, may be one foot in length. The application 124 can divide the measurement data and post-processing dataset within the drilling dataset into the corresponding depth segments 514A-Z. The application 124 can generate a drilling path record 520 comprising the processed dataset, e.g., average values, of the measured data and the periodic datasets corresponding the depth segments 514A-Z. A data segment 516 comprises the processed dataset, e.g., averaged data values, for a depth segment 514. For example, the data segment 516A can correspond to depth segment 514A. The data segment 516 can comprise the well trajectory (e.g., inclination), wellbore environment conditions (e.g., temperature and/or pressure, drilling parameters (e.g., torque, weight on bit, RPM), formation data (e.g., lithology), and mud data (e.g., mud weights, rheology). In the example illustrated in FIG. 5A, the data segment 516 includes a data value for depth value 502, ROP 504, WOB 506, RPM 508, and torque 510. In a scenario, the data segment 516 can include drilling parameter values for the mud system including pump pressure, circulation pressure, flow rate, density, or combinations thereof. In another scenario, the data segment 516 can include wellbore trajectory values for inclination, buildup rate, sliding, or combinations thereof.

Figure 5B:
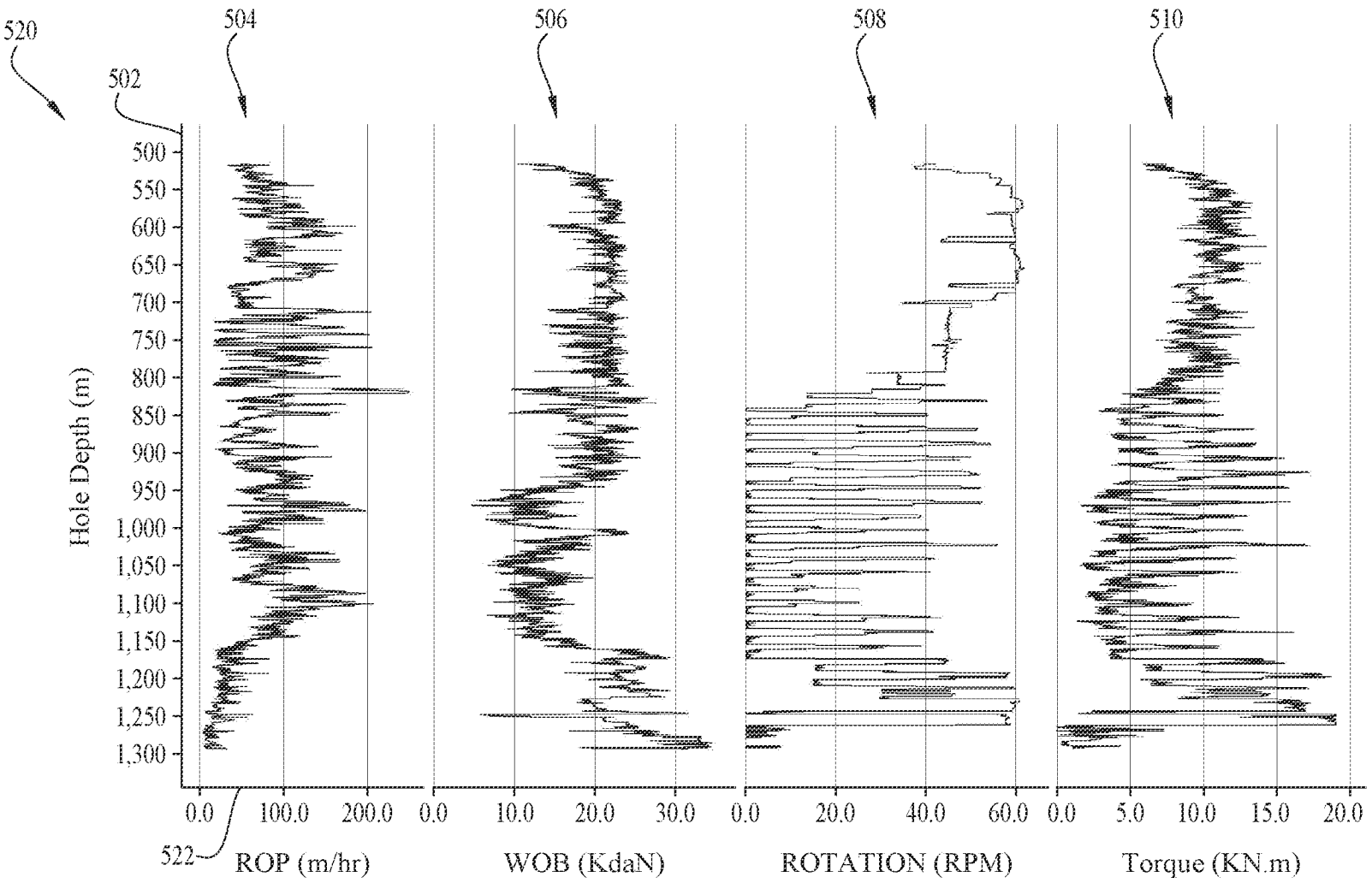
FIG. 5B is an illustration of the graphical display of the drilling path record according to an embodiment of the disclosure.

Turning now to FIG. 5B, a graphical representation of the drilling path record 520 is illustrated. The drilling path record 520 may include measurement values of depth value 502, ROP 504, WOB 506, RPM 508, and torque 510. The graphical representation can utilize the depth value 502 as an axis, e,g., the y-axis. The remaining measurement values may be displayed in columns with an axis that includes a range from a maximum to a minimum value. For example, the ROP 504 may be displayed in a column with depth value 502 as a first axis and ROP values as a second axis 522. The graphical representation may comprise at least one drilling parameter of the drilling path record 520. The user may select parameters values to be displayed. For example, the user may remove torque 510 from the graphical representation. In another scenario, the user may add another drilling parameter to the graphical representation, for example, circulating pressure.

Figure 5C:
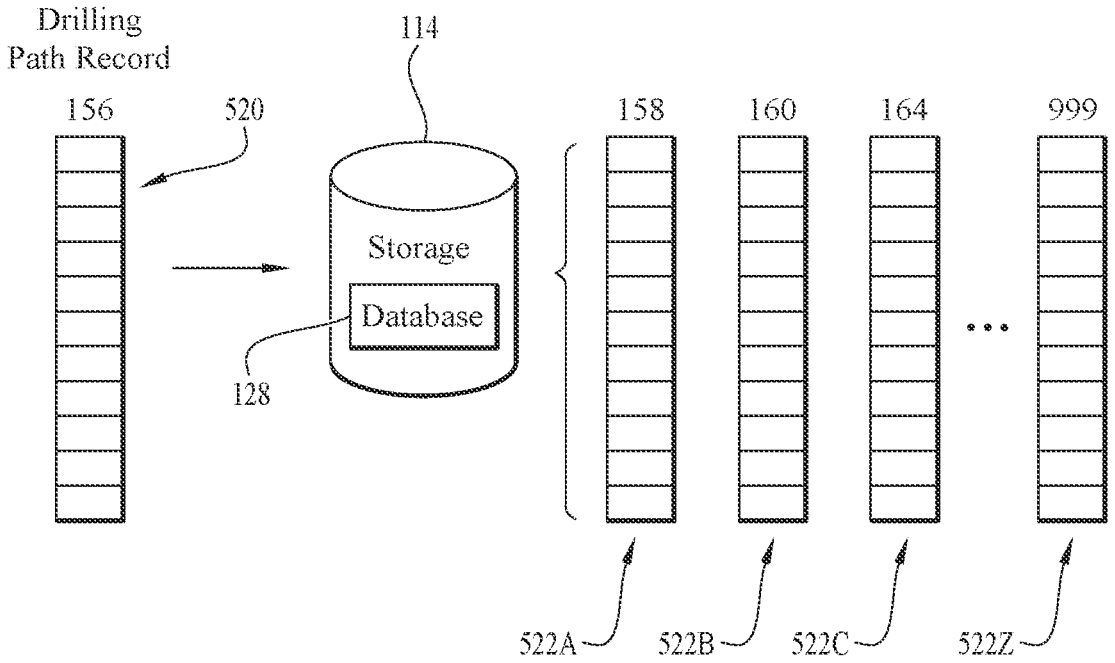
FIG. 5C is an illustration of the storage of the drilling path record according to an embodiment of the disclosure.

Turning now to FIG. 5C, the storage of the drilling path record 520 is illustrated. In some embodiments, the application 124 can save the drilling path record 520 to a historical database 128 in a storage computer 114 as shown in FIG. 2. The historical database 128 can comprise drilling path record 520 from other drilling operations. For example, the drilling path record 520 from FIG. 5A may be generated from offset well 156 in FIG. 4A. The historical database 128 may include drilling path records 522A for offset well 158, drilling path records 522B for offset well 160, and drilling path records 522C for offset well 164. The historical database 128 may include drilling path records 522A through drilling path record 522Z for previous drilling operations. Although the historical database 128 is shown in the storage computer 114, it is understood that the historical database 128 may be located on a computer system, e.g., computer system 122, in the service center 120. In some embodiments, the historical database 128 may be located on a virtual computer system in a communication network, e.g., a 5G network.

Figure 6A:
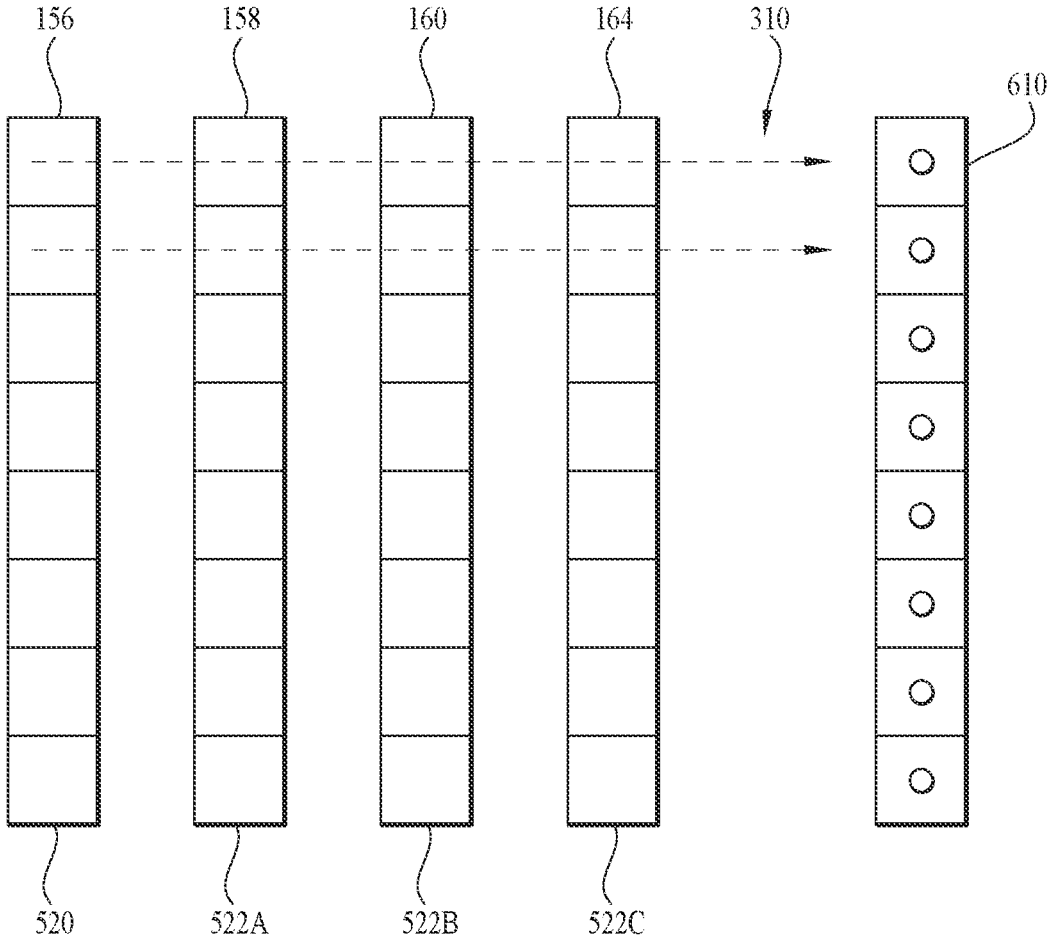
FIG. 6A is an illustration of the method of generating a drilling parameter optimization roadmap according to an embodiment of the disclosure.

Returning to FIG. 3 to continue with step 310, the application 124 may compare the drilling path record 520 for each offset well in the set of offset wells, e.g., offset well 156, selected in step 304 or added to the set of selected offset wells in step 306. The application 124 may determine an optimum drilling roadmap without analysis of the compressive strength of the formation. The application 124 may determine an optimum drilling roadmap based on the comparison of the maximum ROP for the offset wells. Turning now to FIG. 6A, the application 124 can compare the drilling path records 520 of the set of selected offset wells, e,g., well 156, to determine the drilling parameter with the greatest ROP, e,g, the maximum value, for each depth segment 514. In an example, the application 124 can compare the drilling path record 520 for offset well 156 to the drilling path records 522A-C for offset wells 158, 160, and 164. The application 124 can determine the ROP, e.g., ROP 504 in FIG. 5A, for each of the selected offset wells, e.g., offset well 156, to determine the greatest value for ROP 504 for each depth segment, e.g., depth segment 514A. The application 124 can exclude the data segments, e.g., data segment 516A from FIG. 5A, that contain a drilling dysfunction and determine the maximum ROP, e.g., ROP 504, for the remaining data segments 516. For example, the application can determine that drilling path record 522A for offset well 158 includes a drilling dysfunction with the first data segment 516A for the first depth segment 514A and exclude the data segment 516A. The application 124 can generate an optimum drilling roadmap 610 by adding the drilling parameters that resulted in the best ROP from the set of offset wells for each depth segment 514. For example, the application 124 can determine that the drilling path record 520 for the offset well 156 includes the greatest value for ROP 504 for the second data segment 516B for the second depth segment 514B compared to the other offset wells in the set of selected offset wells. The application can write the drilling parameters from the second data segment 516B from the drilling path record 520 for the offset well 156 to the optimum drilling roadmap 610. The application 124 can continue excluding drilling dysfunctions and determining the drilling parameters for the best ROP of the data segments 516 for each of the remaining depth segments 514 from the surface to the bottom of the planned wellbore, e.g., wellsite 152 of FIG. 4A. The application 124 can save the set of optimum drilling parameters for each data segment 516 corresponding to a depth segment 514 of the planned wellbore, e.g., wellsite 152, to memory or to the historical database 128 as the optimum drilling roadmap 610.

The term drilling dysfunction refers to an excessive value of a drilling parameter, e.g., WOB 506, or other parameter related to the drilling operation. The maximum value of each drilling parameter e.g., WOB 506, can be determined empirically by the results of the drilling operation of the offset well, e.g., well 156, by comparing drilling parameters within the historical database 128 to the operational condition of the BHA 10 and/or drill bit 8. The maximum value for each drilling parameter, e.g., torque, can be determined by simulation of the drilling operation. For example, the drilling fluid flowrate and rheology may be simulated to prevent sticking of the drill pipe to the inner wall of the wellbore 6. The maximum value of each drilling parameter, e.g., RPM 508, can be determined by laboratory testing. For example, the maximum weight applied to a drill bit 8, also referred to as WOB 506, may be determined by laboratory testing or provided by a vendor. For example, a value of torque on the drilling bit 8 can exceed a threshold value, the application 124 can determine a drilling dysfunction, and the application 124 can provide an indicia of the drilling dysfunction. The application 124 can determine a drilling dysfunction for a drilling parameter such as WOB, rotational speed of the drilling bit, and the drilling fluid flow rate. The application may also determine drilling dysfunctions associated with the BHA10. These maximum values for each drilling parameter may be referred to as a limit and can be correlated to the drilling equipment, e.g., a drill bit 8, and retrieved by the application 124 from storage computer 114 and/or the historical database 128.

Turning now to FIG. 6B, the identification of drilling dysfunctions is illustrated in the table 614. In another example of step 310, the application 124 may populate a table 614 with a first group 602 of drilling parameters corresponding to a first depth value, e.g., depth value 502. A second group 604 of drilling parameters corresponding to a second depth value. A third group 606 of drilling parameters corresponding to a third depth value. The application 124 may search the column of ROP 504 for the greatest ROP value. For the first group 602, the greatest ROP value is 9 from Well 158. The application 124 may retrieve a drilling parameter limit value for WOB, from the column of WOB 506 must be less than 20 and the limit value for RPM, column of RPM 508, must be less than 60. The application 124 determines the WOB value for Well 158 is greater than 20 and identifies the WOB value as a dysfunction. The application 124 can then determine that the greatest ROP value is 8 from Well 164. The application 124 determines the RPM value is greater than 60 for Well 164 and identifies the RPM value as a dysfunction. The application 124 can restrict the drilling parameters from well 164 from comparison for the first group 602 in response to the identification of the drilling dysfunction. The application 124 determines the greatest ROP value is 7 from well 160 and that the RPM value and WOB values for well 160 are below the limit values. The application 124 saves the drilling parameters for well 160 for the depth value 502 of the first group 602 to the optimum drilling roadmap 610 illustrated in FIG. 6C. The application 124 repeats the process for the second group 604 and the third group 606.

Turning now to FIG. 6C, the optimum drilling roadmap 610 comprises the drilling parameters for the maximum value of ROP for each depth value 502 of the set of selected offset wells, e.g., well 156. Although three rows are shown in the optimum drilling roadmap 610, it is understood that the optimum drilling roadmap 610 comprises a row for each depth segment, e.g., depth segment 514 of FIG. 5A. The number of rows, e.g., number of depth segments, in the optimum drilling roadmap 610 may be any number in the range of 2 to 1,000,000.

Returning to FIG. 3, after the application 124 generates the optimum drilling roadmap 610, the application 124 may export the optimum drilling roadmap 610 to a drilling operation. At step 312, the application 124 can transmit the optimum drilling roadmap 610 to a remote wellsite, e.g., 116 of FIG. 2. The remote wellsite, e.g., 116, can load the optimum drilling roadmap 610 into the unit controller, e.g., unit controller 42 of FIG. 1. The unit controller 42 may comprise an automated drilling process such as Auto-driller to operate the drilling equipment, e.g., BHA 10, per a drilling sequence.

At step 314, the unit controller, e.g., unit controller 42, at the remote wellsite, e.g., 116, can communicatively connect to the application 124 via a wireless communication device e.g., communication device 118 of FIG. 2. The unit controller 42 can transmit periodic datasets to the application 124. The application 124 can provide a display of drilling parameters per the optimum drilling roadmap 610 for the driller to follow via the automated drilling process, e.g., Auto-driller. For example, the display may be a real-time (RT) dashboard to help the driller, e.g., personnel operating the drilling equipment, to stay focused on best performing drilling parameters and forecast at desired depth.

At step 316, the application 124 may record the actual drilling parameters provided by the unit controller 42 at the remote wellsite 116. The application 124 may record the actual drilling parameters of the actual drilled wellbore from surface to the bottom, or completion, of the actual well path.

At step 318, the application 124 can transmit the well dataset from the remote wellsite 116 to the historical database 128 or from the computer system 122 at the service center 120 to the historical database 128. The well dataset comprises the actual drilling parameters received in step 316 along with time-based drilling parameters, geologic data, well trajectory, and daily drilling reports.

The present disclosure can provide a design process to produce an optimized drilling roadmap to direct an automated drilling operation for the drilling of a wellbore. Multiple datasets from the drilling operations of multiple wellsite within the same field can be retrieved by a design process. The design process can produce a drilling path record 520 from each of the datasets corresponding to the previous wellbores drilled by the automated drilling operation. A model can compare the drilling path records, identify drilling dysfunctions, the maximum ROP for each depth segment 514, and produce the drilling parameters corresponding to the maximum ROP for each depth segment 514. The design process can generate an optimum roadmap 610 from the output of the drilling parameters from the model.

Figure 7A:
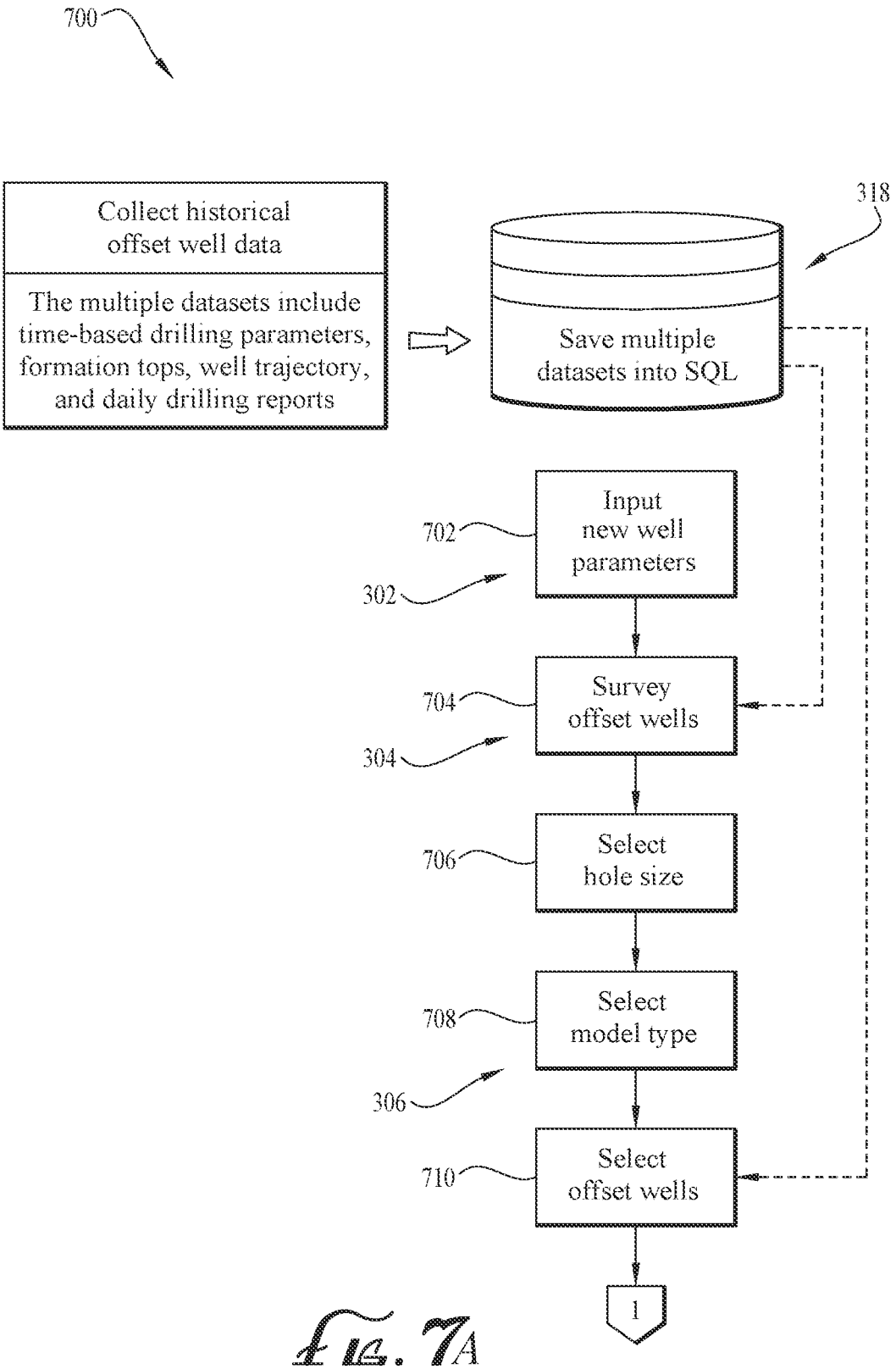
FIGS. 7A, 7B, 7C, and 7D are an illustrations of the logical flow diagram depicting a drilling parameter optimization method according to another embodiment of the disclosure.

Turning now to FIG. 7A, a method for generating an optimum drilling parameters roadmap from historical well data is illustrated by a flow chart. In some embodiments, the method 700 can comprise the following steps executing in a design process, e.g., an application 124. At step 702, a user (via user device 130) can input parameters for a new wellsite, e.g., wellsite 152, into a design process, e.g., application 124. The input parameters can include the hole size, e.g., size of the drill bit 8, the type of drill bit, the BHA 10, and the drilling equipment, e.g., drilling rig 20. This step, step 702, can comprise the same process as step 302 of method 300.

Figure 4B:
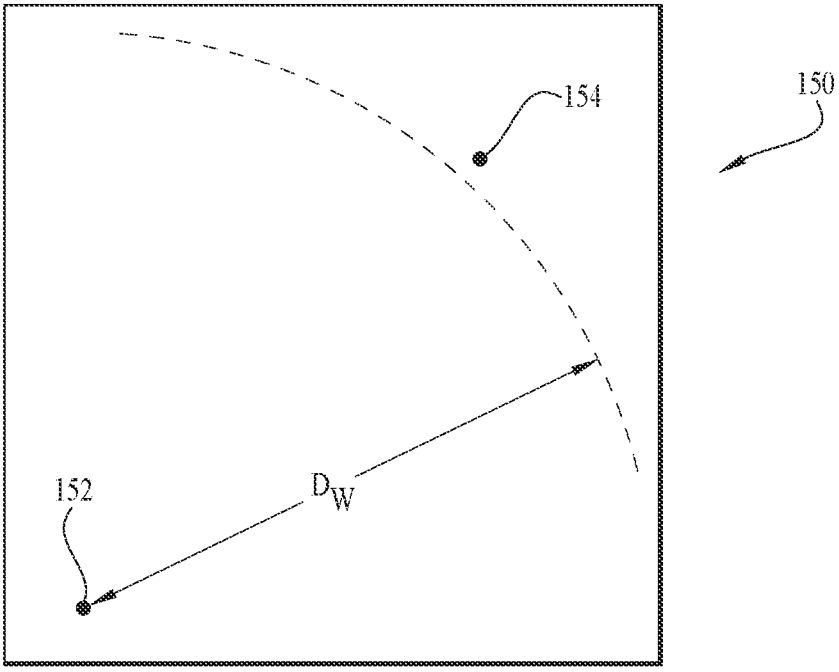

At step 704, the user device 130 can receive a wellsite survey, e.g., survey 150 from FIG. 4A or 4B, from the design process, e.g., application 124. This step can comprise the same process as step 204 of method 300.

At step 706, the design process can receive a drill bit 8, BHA 10, customer inputs, or combinations thereof from the user device 130. The customer inputs may be received from the customer device 136. The user may change the drill bit 8 and/or the BHA 10 based on the wellsite survey 150 and/or the customer inputs. For example, the wellsite survey 150 may not include any offset well data for the BHA 10 inputted into step 702 and the user may change the BHA 10 to match at least one set of offset well data.

At step 708, the design process can recommend an optimization mode via the user device 130. For example, the user can select either using historical pre-defined Auto-driller setpoints (automatic mode) or define maximum allowable drilling parameters (manual mode). In the datasets from the offset wells, the Auto-driller setpoints (limits) are based on drilling equipment data, e.g., drilling bit 8, BHA 10, drill string 12, etc., used in drilling the offset well, e.g., offset wells 156-166 in FIG. 4A, in order to perform the drilling operations within the operational limits of the equipment. The user can select the automatic mode to utilize the datasets within the historical database 128 of the offset wells, e.g., offset wells 156-166. In a different scenario, the user may set the manual mode set drilling parameter control points in the model, e.g., model 126, for new equipment or new technology, e.g., a drill bit 8, that is not in the historical database 128. The defined values for the drilling parameters can used in the model 126 for each depth segment, e.g., foot or meter, to determine the drilling parameters for the maximum ROP for each depth segment. Step 708 of method 700 can comprise the same process as step 306 of method 300.

At step 710, the user can select offset wells, e.g., wells 156-166, from the wellsite survey 150 within the design process, e.g., application 124. The offset wells can be added or removed from a set of selected offset wells.

Although the steps 702-710 are presented sequentially, it is understood that the steps may performed in any order. The steps 702-710 may be repeated or returned to after completion. The steps 702-710 may be combined into a single step without deviating from the design process.

Figure 7B:
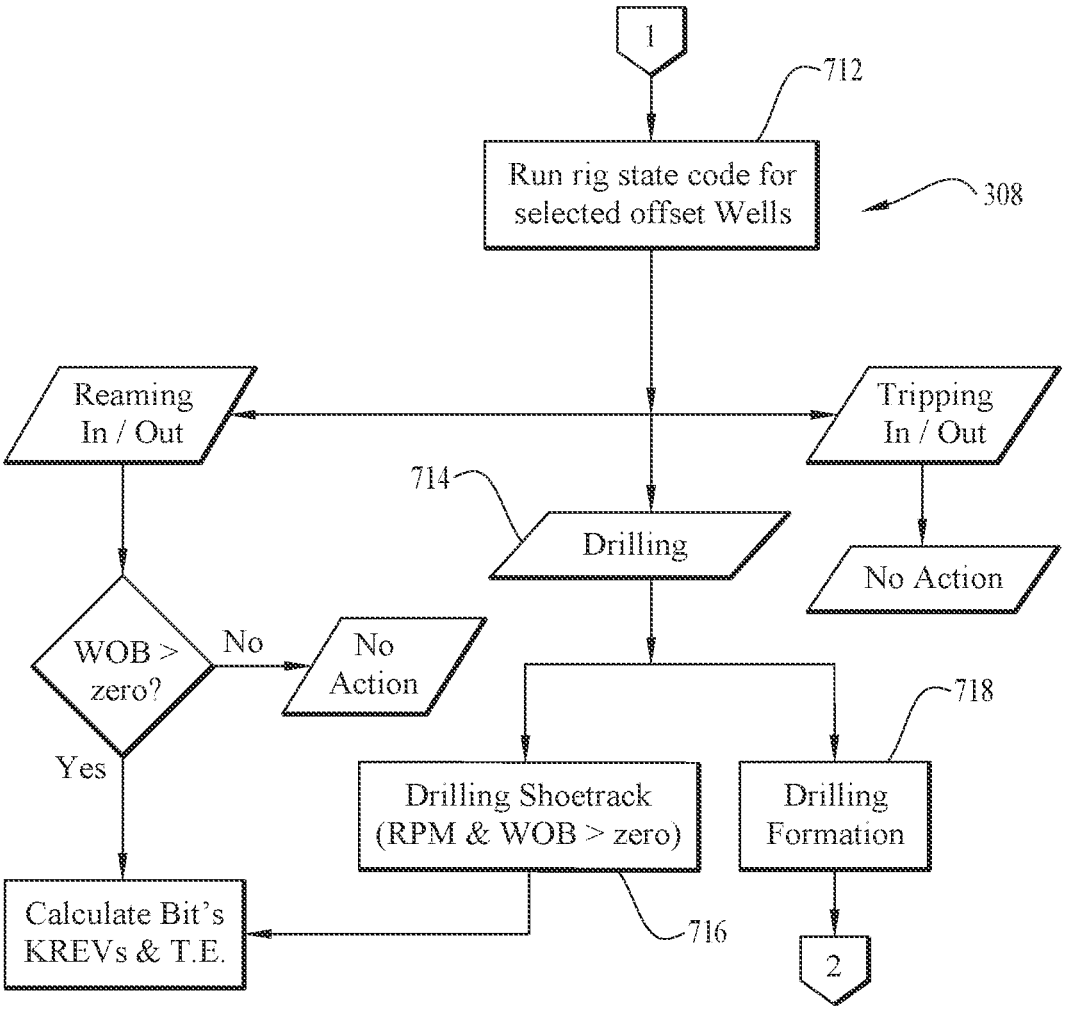
Figure 7C:
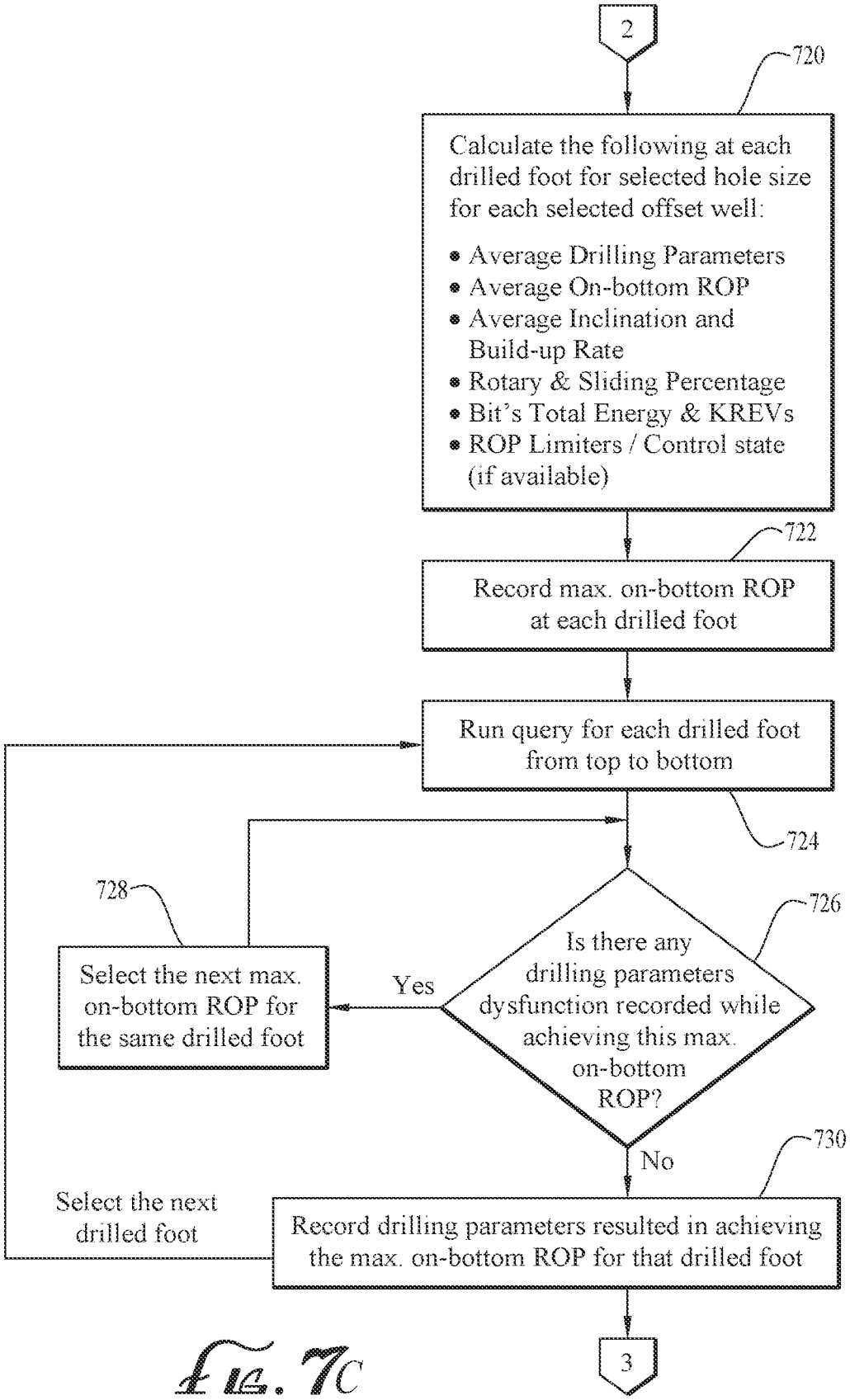

Turning now to FIG. 7B, at step 712, the design process can retrieve a well dataset for the offset wells, e.g., wells 156-166, selected in step 710 from the historical database 128. For example, data collection, cleaning and aggregation will be made on multiple datasets stored in SQL database via a model, e.g., model 126. The model 126 may process the dataset to create a drilling path record 520 for each of the selected offset wells. The model 126 can generate a drilling path record 520 comprising the processed dataset, e.g., average values, of the measured data and the periodic datasets corresponding the depth segments 514A-Z. Step 712 of method 700 can comprise the same process as step 308 of method 300.

At step 714, the design process can analyze the well datasets for periodic datasets indicative of the drilling operation. If the periodic dataset comprises data indicative of the drilling operation, the design process can add the processed data to the drilling path record 520.

At step 716, the design process can determine if the periodic datasets comprise both RPM and WOB data. The design process may determine that the RPMs and WOB are indicative of drilling a shoetrack but not a drilling operation. The design process may determine that the drilling bit total revolutions (KREV) and drilling bit total energy (TE) data are to be considered due to reaming. The design process can exclude periodic datasets without RPM, e.g., tripping in or out of the wellbore 6. The design process can exclude periodic dataset with RPM but without WOB, e.g., reaming operation, and record the RPM for calculation of the KREVS for the drill bit 8.

At step 718, the design process can determine the periodic datasets comprise data indictive of a drilling operation consistent with drilling a formation 4. The design process can generate the processed datasets and add the processed data to the drilling path record 520.

Turning now to FIG. 5C, at step 720, the design process may determine the drilling parameters for each depth segment 514 from surface to the bottom of each of the selected offset wells, e.g., well 156-166. The design process may retrieve the processed datasets from step 718. The depth segments 514 can be measured in feet or meters. The drilling parameters can include average ROP, average inclination and buildup rate, rotary and sliding percentage, drilling bit total energy, KREV, differential pressure, RPM, WOB, ROP limiters, and ROP control state. The ROP limiters can indicate a system in the drilling operation that limits the maximum ROP. The ROP limiters can include Auto-driller system status, maximum limit value of torque, maximum limit value of pump pressure, maximum limit of differential pressure, maximum lip it value of WOB, maximum limit value of ROP, or combinations thereof. For example, the drilling operation may experience a low value of WOB during the drilling operation in a shallow area, e.g., close to surface. The rig operation may not be able to increase the WOB during the shallow drilling portion due to equipment limitations, e.g., a limited amount of drill pipe weight. In a scenario, the ROP may be increased by changing the available rig equipment to increase or remove a ROP limiter. The optimum drilling roadmap 610 can be based on drilling parameters successfully deployed in offset wells and provides optimum ROP matches with the control limits set by the user.

At step 722, the design process may record maximum value for ROP at each depth segment, e.g., each drilled foot. The design process may separate the drilling parameters for each depth segment 514 into a data segment 516 corresponding to the depth segment 514. The design process may produce a table 614, or suitable database, with the data segments 516 for each offset well organized into depth segments 14.

At step 724, the design process may run a query for each depth segment, e.g., each drilled foot, from surface to the bottom of the wellbore. The design process can include or exclude an analysis of the formation compressive strength. The design process can determine the maximum ROP based on the comparison of the data from the drilling operations of the offset wells. Step 724 can be the beginning step in a loop that continues from the first depth segment at the surface until the last depth segment at the bottom or toe of the wellbore 6 is processed.

At step 726, the design process may determine the maximum value of the on bottom ROP for each depth segment for each offset well. For example, with reference to FIGS. 6A and 6B, the design process identifies maximum ROP systematically during querying the offset wells data considering zero drilling parameters dysfunctions at each drilled foot. The design process may then determine the existence of a drilling dysfunction within that maximum on bottom ROP.

At step 728, if a drilling dysfunction exists, the design process may select the next maximum on bottom ROP for that depth segment 514 or group, e.g., the first group 602. In the example shown in FIG. 6B, at depth value 502 of depth 1: the maximum ROP is 9 but the WOB is 21, so the program will check the next high value which is 8 but the RPM is 62 so the program will neglect this ROP value. The next highest ROP is 7 with the WOB and RPM below the threshold values. The design process then selects the drilling parameters for well 160 as the data segment with the maximum ROP and no drilling dysfunction. The design process saves the drilling parameters for well 160 for the first depth segment. The process repeats the process for the second group 604 the third group 606, and all the remaining groups.

At step 730, if a drilling dysfunction is not found, the design process may record the drilling parameters resulted in achieving the maximum on bottom ROP for that depth segment, e.g., that drilled foot. As shown in FIG. 6C, the design process may determine the maximum ROP without a dysfunction for each depth segment and save the results to the optimum drilling roadmap 610.

The design process may return to step 724 in a continual loop from step 724 to 730 until all depth segments 514 from the surface to the bottom of the wellbore are analyzed and recorded.

Figure 7D:
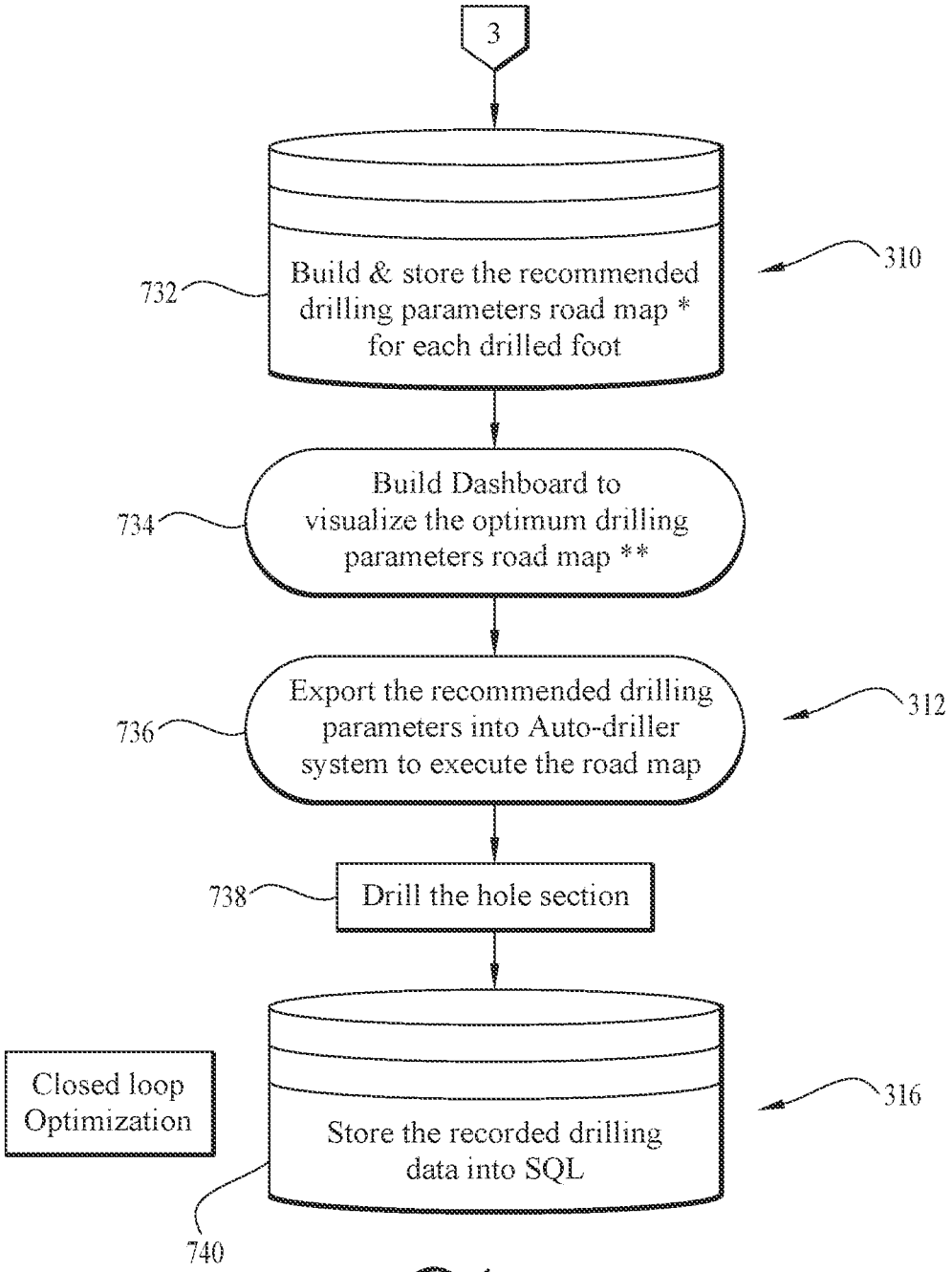

Turning now to FIG. 7D, at step 732 the design process may store the optimum drilling roadmap 610 for each depth segment, e.g., each drilled foot. In some embodiments, the optimum drilling roadmap 610 can be based on drilling parameters successfully deployed in offset wells and provides optimum ROP matches with the control limits set by the user. In some embodiments, the optimum drilling roadmap may be transmitted to a drilling operation, e.g., a drilling rig. Step 732 of method 700 can comprise the same process as step 310 of method 300.

At step 734, in some embodiments, the design process may generate a visual dashboard to visualize the optimum drilling roadmap 610. The dashboard may provide the drilling parameters visualization and the ROP Limiters benchmarking based on the drilling operations of the offset wells. The dashboard may provide assistance to the drillers, e.g., drilling personnel operating the drilling operation, to stay focused on best performing drilling parameters and forecast at the desired depth the remaining bit's KREVs & total energy for drill bits and provided the optimum back-reaming parameters to avoid damaging a portion of the drill bit, e.g., the drill bit cone.

At step 736, in some embodiments the design process may transmit the optimum drilling roadmap 610 to the unit controller 42 on the remote wellsite via the communication device 46. The unit controller 42 can input the optimum drilling roadmap 610 into an Auto-driller process executing on the unit controller 42 to execute the optimum drilling roadmap 610. Step 736 of method 700 can comprise the same process as step 312 of method 300.

At step 738, the remote wellsite 166 may drill the new well, e.g., new wellsite 152, per the optimum drilling roadmap 610. In some embodiments, the unit controller 42 can control the drilling operation (drill the wellbore) per the optimum drilling roadmap 610 via an Auto-driller process executing on the unit controller 42. In an alternative embodiment, the driller, e.g., drilling rig personnel, may drill the wellbore per the optimum drilling roadmap 610 via the visual dashboard. Step 738 of method 700 can comprise the same process as step 314 of method 300.

At step 740, the design process may store the recorded drilling data into database, e.g., database in step 318, or the historical database 128. In some embodiments, the design process may receive at least one dataset of periodic drilling data. The design process may store the at least one dataset to a storage location. In some embodiments, the design process may process the at least one dataset. The design process may store the at least one dataset as a drilling path record. Step 740 of method 700 can comprise the same process as step 316 of method 300.

In some embodiments, the service personnel may transport a drilling operation, e.g., drilling operation 50 of FIG. 1, comprising a set of drilling equipment, e.g., drilling rig 20, a set of drilling tools and a unit controller 42 to a new wellsite, e.g., wellsite 152 as shown in FIGS. 4A and 4B. The unit controller 42 comprises a processor and non-transitory memory. The unit controller 42 may retrieve an optimum drilling roadmap 610 from a database, e.g., database 128. The optimum drilling roadmap 610 may specify a set of drilling tools including a drill bit 8, a BHA 10, or both. The unit controller 42 may begin a drilling operation to drill a wellbore 6 at the new website 152. The drilling operation can include the set of drilling tools comprising the BHA 10, the drill bit 8, or combinations thereof. A design process executing on the unit controller 42 may retrieve at least one dataset of periodic drilling data indicative of the wellbore drilling operation. The dataset comprises drilling equipment datasets, BHA datasets, mud system datasets, daily drilling reports, or combinations thereof. In some embodiments, the unit controller 42 may transmit the at least one dataset of periodic drilling to a storage location including a storage computer 114, a computer system, e.g., computer system 122, or a database, e.g., historical database 128. A design process, e.g., application 124, can retrieve the dataset from the storage location. In some embodiments, the design process may receive the dataset from the unit controller 42. The design process may process the dataset into a portion of a drilling path record. The design process may determine a portion of a set of periodic drilling data indicative of a drilling operation of a new portion of the wellbore. The design process may divide a measured length of the new portion of the wellbore into depth segments 514 and determine a segmented set of periodic datasets, measured values, or combinations thereof for each depth segment 514. The design process may process the segmented set of datasets into processed data values. The design process may generate a portion of the drilling path record 520 with data segments 516 corresponding to the depth segments 514. The design process may update a drilling path record 520 with portion of a drilling path record comprising a set of drilling parameters, e.g., ROP 504 for each depth segment 516. The design process may transmit the drilling path record 520 updated with a portion of a drilling path record to the storage location, e.g., the historical database 128.

Figure 8:
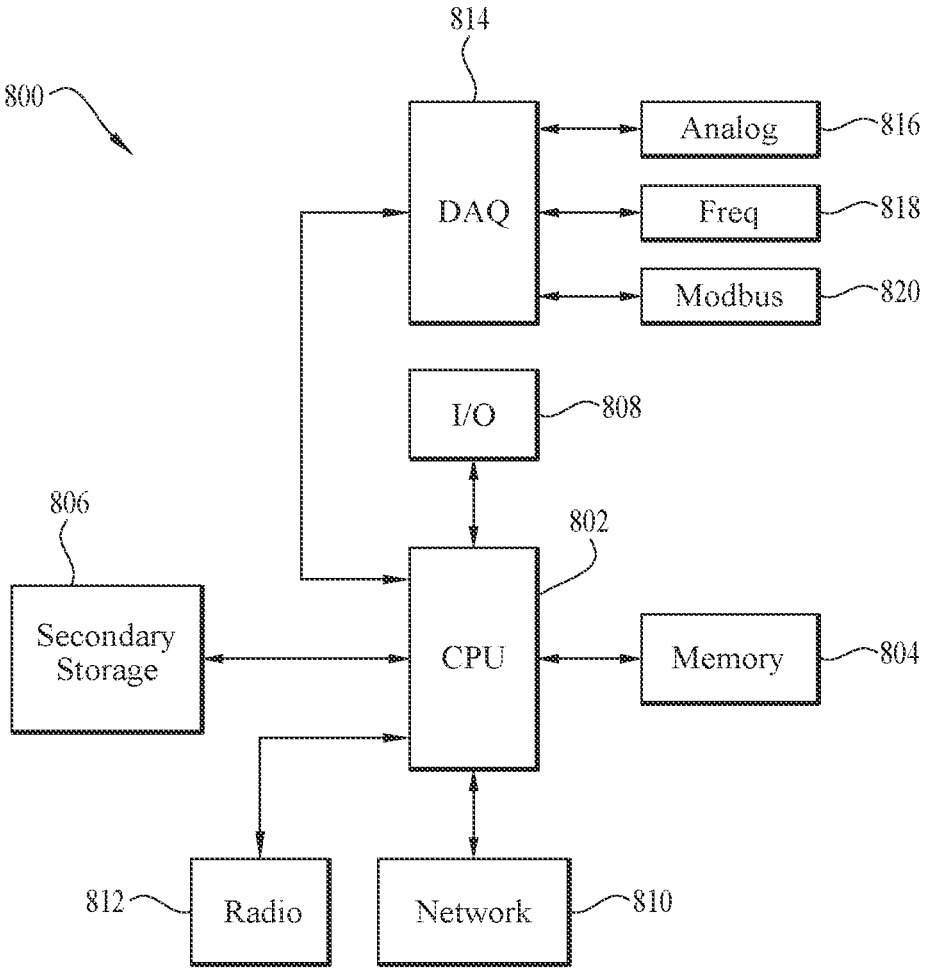
FIG. 8 is a block diagram of a computer system suitable for implementing one or more embodiments of the disclosure.

The unit controller may be a computer system suitable for communication and control of the drilling equipment. In FIG. 1, the unit controller 42 may establish control of the operation of the drilling system, the fluid system, and the communication device 46. In some embodiments, the unit controller 42 may be an exemplary computer system 800 described in FIG. 8. In FIG. 2, the computer system 122, the storage computer 144, and the user devices 130 can be a computer system. Turning now to FIG. 8, a computer system 800 may be suitable for implementing one or more embodiments of the unit controller, for example 42, including without limitation any aspect of the computing system associated with the drilling system of FIG. 1 and the remote wellsite 116 of FIG. 2. The computer system 800 may be suitable for implementing one or more embodiments of the computer system in FIG. 2, for example computer system 122, storage computer 114, user devices 130, and customer device 136. The computer system 800 includes one or more processors 802 (which may be referred to as a central processor nit or CPU) that is in communication with memory 804, secondary storage 806, input output devices 808, DAQ card 814, and network devices 810. The computer system 800 may continuously monitor the state of the input devices and change the state of the output devices based on a plurality of programmed instructions. The programming instructions may comprise one or more applications retrieved from memory 804 for executing by the processor 802 in non-transitory memory within memory 804. The input output devices may comprise a Human Machine Interface with a display screen and the ability to receive conventional inputs from the service personnel such as push button, touch screen, keyboard, mouse, or any other such device or element that a service personnel may utilize to input a command to the computer system 800. The secondary storage 806 may comprise a solid state memory, a hard drive, or any other type of memory suitable for data storage. The secondary storage 806 may comprise removable memory storage devices such as solid state memory or removable memory media such as magnetic media and optical media, i.e., CD disks. The computer system 800 can communicate with various networks with the network devices 810 comprising wired networks, e.g., Ethernet or fiber optic communication, and short range wireless networks such as Wi-Fi (i.e., IEEE 802.11) Bluetooth, or other low power wireless signals such as ZigBee, Z-Wave, 6LoWPan, Thread, and WiFi-ah. The computer system 800 may include a long range radio transceiver 812 for communicating with mobile network providers.

The computer system 800 may comprise a DAQ card 814 for communication with one or more sensors. The DAQ card 814 may be a standalone system with a microprocessor, memory, and one or more applications executing in memory. The DAQ card 814, as illustrated, may be a card or a device within the computer system 800. In some embodiments, the DAQ card 814 may be combined with the input output device 808. The DAQ card 814 may receive one or more analog inputs 816, one or more frequency inputs 818, and one or more Modbus inputs 820. For example, the analog input 816 may include a volume sensor, e.g., a tank level sensor. For example, the frequency input 818 may include a flow meter, i.e., a fluid system flowrate sensor. For example, the Modbus input 820 may include a pressure transducer. The DAQ card 814 may convert the signals received via the analog input 816, the frequency input 818, and the Modbus input 820 into the corresponding sensor data. For example, the DAQ card 814 may convert a frequency input 818 from the flowrate sensor into flow rate data measured in gallons per minute (GPM).

The systems and methods disclosed herein may be advantageously employed in the context of wellbore servicing operations, particularly, in relation to the drilling operations for drilling a new wellbore as disclosed herein.

In some embodiments, a design process may retrieve a drilling dataset indicative of a drilling operation. The design process may generate a drilling path record 520 from the periodic datasets of the drilling dataset. The drilling path record 520 may comprise a plurality of depth segment 514 with data segments 516 with processed data that includes averaged data values. The design process may determine a maximum ROP for each depth segment 514. The design process may repeat the data processing for at least one offset well, e.g., offset well 156. The design process may repeat the data processing and produce a drilling path record 520 for each offset well in a set of selected offset wells, e.g., offset wells 156-164. The design process may compare the data segments 516 of the drilling path records 520 for the set of offset wells to determine the maximum ROP for each depth segment 514 and save the drilling parameters to an optimum drilling roadmap 610. The design process may transmit the optimum drilling roadmap 610 to a remote wellsite 116 via a communication device 118. The optimum drilling roadmap 610 can be inputted into an Auto-driller for control of the drilling equipment of the remote wellsite 116. A wellbore 6 can be drilled using the optimum drilling roadmap 610.

Additionally or alternatively, the design process can receive real-time drilling datasets indicative of a drilling operation. The design process may update a drilling path record 520 by processing the real-time periodic datasets. The drilling path record 520 may comprise depth segment 514 with data segments 516 with averaged data values. The design process may compare the data segments 516 of the drilling path records 520 for the set of offset wells to determine the maximum ROP for each depth segment 514 and save the drilling parameters to an optimum drilling roadmap 610. The design process may transmit the optimum drilling roadmap 610 to a remote wellsite 116 via a communication device 118. The optimum drilling roadmap 610 can be inputted into an Auto-driller for control of the drilling equipment of the remote wellsite 116. A wellbore 6 can be drilled using the optimum drilling roadmap 610.

Additionally or alternatively, the design process can create an optimum drilling parameters road map 610 to maximize on-bottom ROP with minimal drilling dysfunctions. The design process can enhance a drill bits total revolutions, e.g., KREVs, and total energy thus preserving the drill bit life.

Additional Disclosure

The following are non-limiting, specific embodiments in accordance and with the present disclosure:

A first embodiment, which is a computer-implemented method of optimizing a drilling of a wellbore by a wellbore drilling operation, comprising inputting into a design process executing on a computer system at least one offset well proximate to a new wellsite, at least one threshold omit for a drilling parameter, or combination thereof, and wherein the computer system comprises a non-transitory memory and a processor, retrieving, by the design process, a drilling path record for the at least one offset well, wherein the drilling path record comprises at least two depth segments with a data segment corresponding to each depth segment, wherein the data segment comprises a set of drilling parameters, excluding, by the design process, a flagged data segment comprising a drilling dysfunction in response to at least one drilling parameter exceeding at least one threshold value, determining, by the design process, by comparing a value of ROP in each data segment, the data segment with a maximum value of ROP corresponding to each of the depth segments, assigning, by the design process, to an optimum drilling roadmap, the data segment with the maximum ROP corresponding to each of the depth segments, generating, by the design process, the optimum drilling roadmap for the new wellsite in response to determining the data segments with the maximum ROP corresponding to each of the depth segments from a surface to a bottom of a wellbore.

A second embodiment, which is the method of the first embodiment, wherein the set of drilling parameters comprise rate of penetration (ROP), weight on bit (WOB), drill bit rotations per minute (RPM), or combinations thereof.

A third embodiment, which is the method of any of the first and the second embodiments, further comprising generating, by the design process, a wellsite survey from a geographical location of the new wellsite, and wherein the wellsite survey comprises at least one existing wellsite proximate to the new wellsite.

A fourth embodiment, which is the method of any of the first through the third embodiments, further comprising retrieving, by the design process, from a historical database the at least one threshold value for a drilling parameter based on a drilling equipment, a bottom hole assembly (BHA), a drill bit, or combination thereof.

A fifth embodiment, which is the method of any of the first through the fourth embodiments, further comprising retrieving, by the processor, a well dataset for the at least one offset well from a historical database, wherein the well dataset comprises drilling equipment datasets, BHA datasets, mud system datasets, daily drilling reports, or combinations thereof, generating, by the processor, at least two depth segments by dividing a measured wellbore into equal parts or unequal parts, determining, by the processor, for each depth segment from the well dataset, a segmented set of sensor values comprising a segmented set of periodic datasets, a segmented set of measurement values, or combinations thereof, and generating, by the processor, a drilling path record comprising at least two data segments corresponding to the at least two depth segments, wherein the data segment comprises a segmented set of processed data values.

A sixth embodiment, which is the method of the fifth embodiment, further comprising generating, by the processor, a post-processing periodic dataset of each segmented set by applying at least one data reduction techniques to the segmented set of sensor values, wherein the data reduction techniques include data pre-processing, data cleansing, numerosity reduction, or a combination thereof, generating, by the processor, an averaged value for the post-processing periodic dataset by averaging the post-processing periodic dataset with a mathematical averaging technique, wherein the mathematical averaging techniques includes arithmetic mean, a median, a geometric median, a mode, a geometric mean, a harmonic mean, a generalized mean, a moving average, or combination thereof; and assigning, by the processor, to a corresponding depth segment, the segmented set of processed data values comprising the averaged values, the sensor values, or combinations thereof.

A seventh embodiment, which is the method of the fifth embodiment, wherein the drilling equipment datasets comprises measurements of weight on bit (VVOB) revolution per minute (RPM), rate of penetration (ROP), torque, or combinations thereof, wherein the BHA dataset comprises geologic data, wellbore temperature, wellbore pressure, fracture gradient, pore pressure, fluid loss data, lithology, formation porosity, formation permeability, wellbore trajectory, or combinations thereof, wherein the mud system dataset comprises pump pressure, circulation pressure, density, flow rate, mud rheology, fluid returns, fluid loss, daily drilling reports, or combinations thereof, and wherein the daily drilling report comprises drilling bit used, ground elevation, drilling depth, drilling depth progress, daily drilling issues, tubular footage run cement used, well bore survey results, work summary, or combinations thereof.

An eighth embodiment, which is the method of any of the first through the seventh embodiments, further comprising transporting a drilling rig comprising a set of drilling equipment and a unit controller to a new wellsite in response to an output of the optimum drilling roadmap, wherein a drill bit, bottom hole assembly is specified in the optimum drilling roadmap, beginning the drilling operation by the unit controller, retrieving, by the unit controller, at least one dataset of periodic drilling data indicative of the well drilling operation, wherein the datasets comprise drilling parameters, controlling, by the unit controller, a set of drilling parameters, by the set of drilling equipment, per the optimum drilling roadmap; and drilling the wellbore per the optimum drilling roadmap.

A ninth embodiment, which is a computer-implemented method of generating a drilling path record of a wellbore drilling operation, comprising determining, by a design process executing on a computer system, a set of offset wells in response to an input of a geographic location of a new wellsite; wherein the set of offset wells comprises at least two offset wells; wherein the computer system comprises non-transitory memory and a processor, retrieving, by the design process, a threshold value for each drilling parameter in the set of drilling parameters from a historical database, retrieving, by the design process, from a historical database, a drilling path record for the at least two offset wells of the set of offset wells, wherein the drilling path record comprises at least two depth segments with a data segment corresponding to each depth segment, wherein the each data segment comprises a set of drilling parameters; and generating, by the design process, an optimum drilling roadmap comprising the maximum ROP for each depth segment in response to determining the maximum ROP for each of the depth segments from a surface to a bottom of the wellbore.

A tenth embodiment, which is the method of the ninth embodiment, further comprising generating, by the design process, a wellsite survey from the geographical location of the new wellsite, and wherein the wellsite survey comprises the at least two offset wellsite proximate to the new wellsite.

An eleventh embodiment, which is the method of any of the ninth and the tenth embodiment, further comprising retrieving, by the processor, a well dataset for each of the at least two offset wells from the historical database, wherein each well dataset comprises drilling equipment datasets, BHA datasets, mud system datasets, daily drilling reports, or combinations thereof.

A twelfth embodiment, which is the method of the eleventh embodiment, further comprising generating, by the processor, for each well dataset, at least two depth segments by dividing a measured wellbore into equal parts or unequal parts, determining, by the processor, for each depth segment from the well dataset, a segmented set of sensor values comprising a segmented set of periodic datasets, a segmented set of measurement values, or combinations thereof; and generating, by the processor, for each well dataset, a drilling path record comprising the at least two data segments corresponding to the depth segments, wherein the data segment comprises a segmented set of processed data values.

A thirteenth embodiment, which is the method of any of the ninth through the twelfth embodiments, further comprising comparing, by the design process, a first drilling path record to a second drilling path record, wherein the drilling path records correspond to the at least two offset wells of the set of offset wells, excluding, by the design process, each flagged data segment comprising a drilling dysfunction in response to at least one drilling parameter exceeding a threshold value, comparing, by the design process, a comparison data segment of the first drilling path record to a comparison data segment of the second drilling path record for each of the corresponding depth segment, determining, by the design process, the comparison data segment with the maximum ROP corresponding to each of the depth segments; and assigning, by the design process, to an optimum drilling roadmap, the comparison data segment with the maximum ROP corresponding to each of the depth segments.

A fourteenth embodiment, which is the method of any of the ninth through the thirteenth embodiments, further comprising transporting a drilling rig comprising a set of drilling equipment and a unit controller to a new wellsite in response to the generation of the optimum drilling roadmap, beginning the drilling operation by the unit controller, controlling, by the unit controller, a set of drilling parameters, by the set of drilling equipment, per the optimum drilling roadmap; and drilling the wellbore per the optimum drilling roadmap.

A fifteenth embodiment, which is a method of drilling a wellbore, comprising transporting a drilling rig comprising a set of drilling equipment, a set of drilling tools, and a unit controller to a new wellsite, retrieving, by the unit controller, an optimum drilling roadmap from a database, wherein the set of drilling tools is specified in the optimum drilling roadmap, and wherein the set of drilling tools includes a drill bit, bottom hole assembly, or both, wherein the unit controller comprises a processor and non-transitory memory, beginning a wellbore drilling operation by the unit controller, wherein the wellbore drilling operation includes drilling a wellbore at the new wellsite with the set of drilling tools, retrieving, by a design process executing on the unit controller, at least one dataset of periodic drilling data indicative of the wellbore drilling operation, wherein the at least one dataset comprises drilling parameters, updating, by the design process, a drilling path record with a portion of the drilling path record, wherein the drilling path record comprises a set of drilling parameters for each depth segment; and transmitting the drilling path record to a storage location.

A sixteenth embodiment, which is the method of the fifteenth embodiment, wherein the at least one dataset of periodic drilling data comprises drilling equipment datasets, BHA datasets, mud system datasets, daily drilling reports, or combinations thereof.

A seventeenth embodiment, which is the method of the sixteenth embodiment, wherein the drilling equipment datasets comprises measurements of weight on bit (WOB), revolution per minute (RPM), rate of penetration (ROP), torque, or combinations thereof, wherein the BHA dataset comprises geologic data, wellbore temperature, wellbore pressure, fracture gradient, pore pressure, fluid loss data, lithology, formation porosity, formation permeability, wellbore trajectory, or combinations thereof, wherein the mud system dataset comprises pump pressure, circulation pressure, density, flow rate, mud theology, fluid returns, fluid loss, daily drilling reports, or combinations thereof, and wherein the daily drilling report comprises drilling bit used, ground elevation, drilling depth, drilling depth progress, daily drilling issues, tubular footage run, cement used, well bore survey results, work summary, or combinations thereof.

An eighteenth embodiment, which is the method of any of the fifteenth through the seventeenth embodiments, further comprising determining, by the design process, a portion of a set of periodic drilling data indicative of the drilling operation, wherein the drilling operation comprises drilling a formation, and wherein the portion of the set of periodic drilling data comprises an average ROP, an average inclination and buildup rate, a rotary and sliding percentage, or combinations thereof, determining, by the processor, a measured length of wellbore from the portion of the set of periodic drilling data, generating, by the processor, a set of current depth segments by dividing the measured length of wellbore into equal parts or unequal parts, and wherein the set of current depth segments are consecutively sequenced beginning from a previous set of depth segments, determining, by the processor, for each current depth segment, a segmented set of periodic datasets, a segmented set of measurement values, or combinations thereof, and generating, by the processor, a portion of a drilling path record comprising the set of data segments corresponding to the set of current depth segments, wherein the data segment comprises a segmented set of processed data values.

A nineteenth embodiment, which is the method of the eighteenth embodiment, further comprising generating, by the processor, a post-processing periodic dataset of each segmented set by applying at least one data reduction techniques to the each segmented set of periodic dataset, wherein the data reduction techniques include data preprocessing, data cleansing, numerosity reduction, or a combination thereof, generating, by the processor, an averaged value for the post-processing periodic dataset by averaging the post-processing periodic dataset with a mathematical averaging technique, wherein the mathematical averaging techniques includes arithmetic mean, a median, a geometric median, a mode, a geometric mean, a harmonic mean a generalized mean, a moving average, or combination thereof, and assigning, by the processor, to a corresponding depth segment, the segmented set of processed data values comprising the averaged values, the measurement values, or combinations thereof.

A twentieth embodiment, which is the method of any of the fifteenth through the nineteenth embodiments, wherein the drilling parameters comprise an average rate of penetration (ROP), an average inclination, an average buildup rate, a value for a drill bit total energy, a value for a drilling bit total revolutions (KREV), a set of ROP limiters, a ROP control state, rate of penetration (ROP), weight on bit (WOB), drill bit rotations per minute (RPM) a value for a drilling fluid flowrate, a value for a pressure differential, or combinations thereof.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A computer-implemented method of generating a drilling path record of a wellbore drilling operation, comprising:

determining, by a design process executing on a computer system, a set of offset wells in response to an input of a geographic location of a new wellsite; wherein the set of offset wells comprises at least two offset wells; wherein the computer system comprises non-transitory memory and a processor;

retrieving, by the design process, a threshold value for each drilling parameter in a set of drilling parameters from a historical database;

retrieving, by the design process, from the historical database, a drilling path record for the at least two offset wells, wherein the drilling path record comprises at least two depth segments with a data segment corresponding to each depth segment, wherein each data segment comprises the set of drilling parameters;

excluding, by the design process, each flagged data segment comprising a drilling dysfunction in response to at least one drilling parameter exceeding a threshold value; and generating, by the design process, an optimum drilling roadmap comprising a maximum rate of penetration (ROP) for each depth segment, based on the drilling path record, wherein a wellbore is drilled according to the optimum drilling roadmap.

2. The method of claim 1, further comprising:

generating, by the design process, a wellsite survey from the geographical location of the new wellsite, and wherein the wellsite survey comprises the at least two offset wells proximate to the new wellsite.

3. The method of claim 1, further comprising:

retrieving, by the processor, a well dataset for each of the at least two offset wells from the historical database, wherein each well dataset comprises drilling equipment datasets, BHA datasets, mud system datasets, daily drilling reports, or combinations thereof.

4. The method of claim 3, further comprising:

generating, by the processor, for each well dataset, at least two depth segments by dividing a measured wellbore into equal parts or unequal parts;

determining, by the processor, for each depth segment from the well dataset, a segmented set of sensor values comprising a segmented set of periodic datasets, a segmented set of measurement values, or combinations thereof; and generating, by the processor, for each well dataset, a drilling path record comprising the at least two data segments corresponding to the depth segments, wherein the data segment comprises a segmented set of processed data values.

5. The method of claim 1, further comprising:

comparing, by the design process, a first drilling path record to a second drilling path record, wherein the drilling path records correspond to the at least two offset wells of the set of offset wells;

comparing, by the design process, a comparison data segment of the first drilling path record to a comparison data segment of the second drilling path record for each of the corresponding depth segments;

determining, by the design process, the comparison data segment with the maximum ROP corresponding to each of the depth segments; and assigning, by the design process, to the optimum drilling roadmap, the comparison data segment with the maximum ROP corresponding to each of the depth segments.

6. The method of claim 1, further comprising:

transporting a drilling rig comprising a set of drilling equipment and a unit controller to a the new wellsite in response to the generation of the optimum drilling roadmap;

beginning the drilling operation by the unit controller;

controlling, by the unit controller, a set of drilling parameters, by the set of drilling equipment, per the optimum drilling roadmap; and drilling the wellbore per the optimum drilling roadmap.

7. The method of claim 1, further comprising comparing, by the design process, a first drilling path record to a second drilling path record.

8. The method of claim 7, wherein the first drilling path record and the second drilling path record correspond to the at least two offset wells of the set of offset wells.

9. The method of claim 8, wherein the drilling dysfunction is determined by a comparison of a value to a threshold.

10. The method of claim 9, further comprising comparing, by the design process, a comparison data segment of the first drilling path record to a comparison data segment of the second drilling path record for each of the corresponding depth segments.

11. The method of claim 10, further comprising determining, by the design process, the comparison data segment with the maximum ROP corresponding to each of the depth segments.

12. The method of claim 11, further comprising assigning, by the design process, to the optimum drilling roadmap, the comparison data segment with the maximum ROP corresponding to each of the depth segments.

13. The method of claim 12, wherein the first drilling path record is generated by:

retrieving, by the processor, a well dataset for each of the at least two offset wells from the historical database, wherein each well dataset comprises drilling equipment datasets, BHA datasets, mud system datasets, daily drilling reports, or combinations thereof;

generating, by the processor, for each well dataset, at least two depth segments by dividing a measured wellbore into equal parts or unequal parts;

determining, by the processor, for each depth segment from the well dataset, a segmented set of sensor values comprising a segmented set of periodic datasets, a segmented set of measurement values, or combinations thereof; and generating, by the processor, for each well dataset, the first drilling path record comprising the at least two data segments corresponding to the depth segments, wherein the data segment comprises a segmented set of processed data values.

14. The method of claim 12, wherein the second drilling path record is generated by:

retrieving, by the processor, a well dataset for each of the at least two offset wells from the historical database, wherein each well dataset comprises drilling equipment datasets, BHA datasets, mud system datasets, daily drilling reports, or combinations thereof;

generating, by the processor, for each well dataset, at least two depth segments by dividing a measured wellbore into equal parts or unequal parts;

determining, by the processor, for each depth segment from the well dataset, a segmented set of sensor values comprising a segmented set of periodic datasets, a segmented set of measurement values, or combinations thereof; and generating, by the processor, for each well dataset, the second drilling path record comprising the at least two data segments corresponding to the depth segments, wherein the data segment comprises a segmented set of processed data values.

15. The method of claim 1, further comprising transporting a drilling rig comprising a set of drilling equipment and a unit controller to a new wellsite in response to the generation of the optimum drilling roadmap.

16. The method of claim 15, further comprising beginning the drilling operation by the unit controller.

17. The method of claim 16, further comprising controlling, by the unit controller, a set of drilling parameters, by the set of drilling equipment, per the optimum drilling roadmap.

18. The method of claim 1, wherein the drilling dysfunction comprises a value of torque on a drill bit exceeding a threshold value.

19. The method of claim 1, wherein the drilling dysfunction comprises a value of weight on a drill bit exceeding a threshold value.

* * * * *